US009435517B2

(12) United States Patent
Gordin et al.

(10) Patent No.: US 9,435,517 B2
(45) **Date of Patent: *Sep. 6, 2016**

(54) APPARATUS, METHOD, AND SYSTEM FOR INDEPENDENT AIMING AND CUTOFF STEPS IN ILLUMINATING A TARGET AREA

(71) Applicant: Musco Corporation, Oskaloosa, IA (US)

(72) Inventors: Myron Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 160 days.

This patent is subject to a terminal disclaimer.

(21) Appl. No.: 14/307,847

(22) Filed: Jun. 18, 2014

(65) Prior Publication Data

US 2014/0301078 A1 Oct. 9, 2014

Related U.S. Application Data

(63) Continuation of application No. 13/471,804, filed on May 15, 2012, now Pat. No. 8,789,967.

(60) Provisional application No. 61/492,426, filed on Jun. 2, 2011.

(51) Int. Cl.
*F21V 14/00* (2006.01)
*F21S 8/08* (2006.01)
(Continued)

(52) U.S. Cl.
CPC ..... *F21V 14/00* (2013.01); *F21S 4/00* (2013.01); *F21S 8/088* (2013.01); *F21V 7/00* (2013.01);
(Continued)

(58) Field of Classification Search
CPC ..... F21V 7/0025; F21V 14/02; F21V 14/00; F21V 21/30; F21V 19/02; F21V 7/00; F21V 21/00; F21V 7/05; F21V 29/73; F21V 17/02; F21V 14/04; F21V 14/06; F21S 4/00; F21S 8/088; Y10T 29/49826; F21W 2131/105; F21Y 2101/02; F21Y 2103/003
See application file for complete search history.

(56) References Cited

U.S. PATENT DOCUMENTS 1,176,475 A 3/1916 McPherson
D57,890 S 5/1921 Collier
(Continued)

FOREIGN PATENT DOCUMENTS

EP 2056020 6/2009
WO 2005059436 6/2005

OTHER PUBLICATIONS

Gordin, Myron, et al., "Apparatus, Method and System for On-Site Evaluation of Illumination Scheme Using Mobile Lighting Evaluation System", U.S. Appl. No. 12/604,572, filed Oct. 23, 2009.
(Continued)

*Primary Examiner* — Bao Q Truong
(74) *Attorney, Agent, or Firm* — McKee, Voorhees & Sease, PLC

(57) ABSTRACT

A lighting fixture is presented comprising a plurality of modular apparatuses wherein each modular apparatus comprises one or more light sources and one or more light directing or light redirecting devices. Methods of adjusting one or more components of said lighting fixture about one, two, or three axes are presented whereby the lighting needs of a target area—even one of complex shape—may be addressed and in a manner that promotes compact fixture design with low effective projected area (EPA) without sacrificing transmission efficiency of the light sources.

19 Claims, 26 Drawing Sheets

(51) Int. Cl.

| | |
|---|---|
| ***F21V 14/02*** | (2006.01) |
| ***F21V 21/30*** | (2006.01) |
| ***F21V 7/05*** | (2006.01) |
| ***F21S 4/00*** | (2016.01) |
| ***F21V 7/00*** | (2006.01) |
| ***F21V 19/02*** | (2006.01) |
| ***F21V 21/00*** | (2006.01) |
| ***F21V 29/73*** | (2015.01) |
| *F21W 131/105* | (2006.01) |
| *F21Y 101/02* | (2006.01) |
| *F21Y 103/00* | (2016.01) |

(52) U.S. Cl.

CPC ..... *F21V 7/0025* (2013.01); *F21V 7/05* (2013.01); *F21V 14/02* (2013.01); *F21V 19/02* (2013.01); *F21V 21/00* (2013.01); *F21V 21/30* (2013.01); *F21V 29/73* (2015.01); *F21W 2131/105* (2013.01); *F21Y 2101/02* (2013.01); *F21Y 2103/003* (2013.01); *Y10T 29/49826* (2015.01)

(56) References Cited

U.S. PATENT DOCUMENTS

| | | | | |
|---|---|---|---|---|
| D191,762 | S | 11/1961 | Rothman et al. | |
| D201,884 | S | 8/1965 | Blake et al. | |
| D255,941 | S | 7/1980 | Grant | |
| D267,005 | S | 11/1982 | Dennis | |
| 4,796,169 | A | 1/1989 | Shemitz | |
| D316,306 | S | 4/1991 | Shemitz | |
| D338,449 | S | 8/1993 | Sahyoun | |
| D364,478 | S | 11/1995 | Pesau | |
| 5,647,661 | A | 7/1997 | Gordin | |
| D387,333 | S | 12/1997 | Pellow et al. | |
| D390,992 | S | 2/1998 | Shemitz | |
| 5,800,048 | A | 9/1998 | Gordin | |
| 5,806,956 | A | 9/1998 | Hyun-Jo | |
| 5,860,733 | A | 1/1999 | Stone et al. | |
| D426,195 | S | 6/2000 | Kuo | |
| D429,703 | S | 8/2000 | Gauffin | |
| D438,135 | S | 2/2001 | DiDomizio et al. | |
| 6,250,596 | B1 | 6/2001 | Gordin et al. | |
| D468,473 | S | 1/2003 | Shemitz et al. | |
| D472,339 | S | 3/2003 | Russello et al. | |
| 6,614,358 | B1 | 9/2003 | Hutchison et al. | |
| D485,636 | S | 1/2004 | Patterson et al. | |
| 6,883,935 | B2 * | 4/2005 | Lassovsky | F21S 8/026 362/283 |
| D507,903 | S | 8/2005 | Pingel | |
| D512,526 | S | 12/2005 | Zucker | |
| 7,059,572 | B2 | 6/2006 | Ware et al. | |
| D530,668 | S | 10/2006 | Carson et al. | |
| 7,209,958 | B2 | 4/2007 | Crookham et al. | |
| 7,325,928 | B2 | 2/2008 | Bhowmik et al. | |
| 7,458,700 | B2 | 12/2008 | Gordin | |
| 7,484,866 | B1 | 2/2009 | Buse | |
| D595,445 | S | 6/2009 | Gunter | |
| D595,894 | S | 7/2009 | Verfuerth et al. | |
| D616,138 | S | 5/2010 | Lasthein et al. | |
| 7,712,926 | B2 | 5/2010 | Matheson | |
| D621,968 | S | 8/2010 | Schultz | |
| 7,771,087 | B2 | 8/2010 | Wilcox et al. | |
| 7,789,540 | B2 | 9/2010 | Gordin et al. | |
| D629,548 | S | 12/2010 | Cai | |
| 7,845,827 | B2 | 12/2010 | Tarter et al. | |
| D632,006 | S | 2/2011 | Verfuerth et al. | |
| D633,230 | S | 2/2011 | Chen | |
| 7,946,738 | B2 | 5/2011 | Fowler, Jr. et al. | |
| D641,908 | S | 7/2011 | McKee | |
| D644,370 | S | 8/2011 | Lickiss | |
| 8,113,680 | B2 * | 2/2012 | O'Brien | F21S 8/026 362/147 |
| D659,895 | S | 5/2012 | Maxik et al. | |
| D661,008 | S | 5/2012 | Yuan | |
| D670,421 | S | 11/2012 | Herberholt | |
| D670,422 | S | 11/2012 | Siekmann | |
| D672,902 | S | 12/2012 | Collins et al. | |
| 8,342,709 | B2 | 1/2013 | Lueken et al. | |
| 8,342,714 | B1 | 1/2013 | Rea et al. | |
| 8,398,273 | B2 | 3/2013 | Eberhardt | |
| 8,789,967 | B2 * | 7/2014 | Gordin | F21S 4/00 362/223 |
| 2004/0037068 | A1 | 2/2004 | Patterson et al. | |
| 2005/0047138 | A1 | 3/2005 | Rochna | |
| 2008/0080189 | A1 | 4/2008 | Wang | |
| 2009/0109670 | A1 | 4/2009 | Boyer | |
| 2009/0122550 | A1 | 5/2009 | Gordin et al. | |
| 2009/0262533 | A1 | 10/2009 | Liu et al. | |
| 2010/0020551 | A1 | 1/2010 | Kay et al. | |
| 2010/0110671 | A1 | 5/2010 | Gordin et al. | |
| 2010/0165654 | A1 | 7/2010 | Okubo et al. | |
| 2010/0195326 | A1 | 8/2010 | Boxler et al. | |
| 2011/0074313 | A1 | 3/2011 | Gordin | |
| 2011/0149582 | A1 | 6/2011 | McKee | |
| 2012/0039077 | A1 | 2/2012 | Householder | |
| 2012/0217897 | A1 | 8/2012 | Gordin et al. | |
| 2012/0307486 | A1 | 12/2012 | Gordin et al. | |
| 2013/0077304 | A1 | 3/2013 | Gordin et al. | |

OTHER PUBLICATIONS

Boxler, Lawrence H., et al., "Apparatus, Method and System fdor Providing Color LED Output Using Thin-Film Optic Coatings", U.S. Appl. No. 61/804,311, filed Mar. 22, 2013.

Gordin, Myron, et al., "Apparatus, Method and System for Lighting Fixture Cooking", U.S. Appl. No. 13/791,941, filed Mar. 9, 2013.

Gordin, Myron, et al., "Apparatus, Method and System for Reducing the Effective Projected Area (EPA) of an Elevated Lighting Fixture without the use of an External Visor", U.S. Appl. No. 61/708,298, filed Oct. 1, 2012.

Gordin, Myron, et al., "Domed Downlight Fixture", U.S. Appl. No. 29/433,483, filed Oct. 1, 2012.

Musco Corporation et al., PCT/US2012/037935, International Search Report and Written Opinion of the International Searching Authority, mailed Jan. 29, 2013.

Musco Corporation, PCT/US2013/041863, filed on May 20, 2013 "The International Search Report and the Written Opinion of the International Searching Authority, or the Declaration", mailed Aug. 28, 2013.

* cited by examiner

SECTION A-A

APPARATUS, METHOD, AND SYSTEM FOR INDEPENDENT AIMING AND CUTOFF STEPS IN ILLUMINATING A TARGET AREA

CROSS-REFERENCE TO RELATED APPLICATIONS

This application is a continuation application of U.S. application Ser. No. 13/471,804 filed May 15, 2012, issued as U.S. Pat. No. 8,789,967 on Jul. 29, 2014, which claims priority under 35 U.S.C. §119 to provisional U.S. Application Ser. No. 61/492,426 filed Jun. 2, 2011, all of which are incorporated by reference in their entirety.

BACKGROUND OF THE INVENTION

The present invention generally relates to means and methods by which a target area is adequately illuminated by one or more lighting fixtures. More specifically, the present invention relates to improvements in the design and use of lighting fixtures such that the steps of aiming and cutoff of light projected from said lighting fixtures may be separated so to gain more flexibility in addressing the lighting needs of a particular application without adversely affecting the size, effective projected area, or efficiency of the lighting fixtures.

It is well known that to adequately illuminate a target area—particularly a target area of complex shape—a combination of light directing (e.g., aiming, collimating) and light redirecting (e.g., blocking, reflecting) efforts are needed; see, for example, U.S. Pat. No. 7,458,700 incorporated by reference herein. This concept is generally illustrated in FIGS. 1A-C for the example of a sports field illuminated by a plurality of elevated floodlight-type fixtures. As can be seen from FIG. 1A, in the un-aimed state a fixture 4 illuminates some portion of target area 5 (which typically comprises not only the horizontal plane containing the sports field, but also a finite space above and about said field); this illumination is diagrammatically illustrated by projected beam 7 wherein the hatched portion of beam 7 is considered desirable. Adjusting fixture 4 relative to pole 6 (e.g., by pivoting about its attachment point) aims beam 7 toward the leftmost portion of target area 5 as desired (see FIG. 1B), but also results in the lighting of undesired areas such as bleachers 515. This light, commonly referred to as spill light, is wasteful and a potential nuisance (e.g., to spectators in bleachers 515) or hazardous (e.g., to drivers on a road adjacent to target area 5). To adequately eliminate spill light, a visor or analogous device may be added to fixture 4 (see FIG. 1C) to provide a desired cutoff. Some visors, such as those disclosed in U.S. Pat. No. 7,789,540 incorporated by reference herein, are equipped with inner reflective surfaces so to both cut off light and redirect said light back onto target area 5 so it is not absorbed or otherwise wasted.

There are limitations to the approach illustrated in FIGS. 1A-C. For example, the adjustment of fixture 4 relative to pole 6 and addition of a visor may adversely affect the fixture's effective projected area (EPA) which may increase wind loading. An increased EPA may require a more substantial pole or more robust means of affixing the fixture to the pole, both of which may add cost. Given that a typical wide area or sports lighting application utilizes multiple poles with many fixtures per pole—see, for example, aforementioned U.S. Pat. No. 7,458,700—the added cost from even a slight change to EPA can be substantial.

As another example, the approach in FIGS. 1A-C is most appropriate for fixtures containing a single light source such as the high wattage HID lamps used in the aforementioned U.S. Pat. Nos. 7,458,700 and 7,789,540. It is well known that there is a need in the industry to create more efficient lighting fixtures; efficient in the sense that the fixtures themselves get more light out of the fixture housing and onto the target area, and in the sense that the light sources themselves are more compact while demonstrating a comparable or higher efficacy. This poses a problem because when multiple smaller light sources (e.g., LEDs) are housed in fixture 4, a single visor may not adequately redirect all spill light back onto target area 5 or provide a distinct cutoff; this can result in uneven illumination, shadowing effects, or glare which can be a nuisance or potentially dangerous (e.g., affecting playability on the field).

Accordingly, there is a need in the art for a design of lighting fixture which can realize the benefits of multiple smaller light sources such as LEDs (e.g., long life, high efficacy, ability to aim to multiple points, greater flexibility in creating lighting uniformity, etc.) while preserving desirable features of said fixture (e.g., low EPA, high coefficient of utilization, etc.), and a method of operating such so to address the lighting needs of a target area while avoiding undesirable lighting effects (e.g., uneven illumination, shadowing effects, glare, etc.).

SUMMARY OF THE INVENTION

Envisioned is a compact lighting fixture designed to accommodate a plurality of light sources, and means and methods for independent light directing and light redirecting thereof such that a complex target area may be adequately illuminated with increased glare control, reduced EPA, and increased lighting uniformity as compared to at least most conventional floodlight-type fixtures for sports lighting applications.

It is therefore a principle object, feature, advantage, or aspect of the present invention to improve over the state of the art and/or address problems, issues, or deficiencies in the art.

According to one aspect of the present invention, a modular apparatus comprises a plurality of light sources—with associated optical elements—contained in a housing with a visor. Said modular apparatus is designed such that the plurality of light sources and visor pivot about one, two, or three axes and, if desired, are independently pivotable about at least one of said axes.

According to another aspect of the present invention, a lighting fixture comprising a plurality of said modular apparatuses is adjusted relative to its elevation point above a target area to provide some aiming of the light projected therefrom. Each modular apparatus may then be adjusted relative to its connection point to the lighting fixture to provide further aiming of the light projected therefrom. Following this, or in addition, each light source and each visor in each modular apparatus may be adjusted selectively and independently of one another so to provide desired aiming and cutoff. In this manner, the light projected from each modular apparatus contributes a portion of the overall lighting of the target area; this permits flexibility in addressing such things as glare prevention and lighting uniformity.

These and other objects, features, advantages, or aspects of the present invention will become more apparent with reference to the accompanying specification and claims.

BRIEF DESCRIPTION OF THE DRAWINGS

From time-to-time in this description reference will be taken to the drawings which are identified by figure number and are summarized below.

FIG. 1A illustrates an un-aimed lighting fixture, FIG. 1B illustrates the fixture from FIG. 1A aimed, and FIG. 1C illustrates the fixture from FIG. 1A aimed and with cutoff.

FIGS. 2A-D illustrate perspective views, FIG. 2E illustrates a front view, and FIG. 2F illustrates a section view along cut line A-A of FIG. 2E.

FIGS. 5A and B are perspective views of the pole and fixture, and FIGS. 5C and D are enlarged perspective views of the fixture.

FIG. 6A illustrates an un-aimed lighting fixture, FIG. 6B illustrates the fixture from FIG. 6A pivoted about a first axis, FIG. 6C illustrates the fixture from FIG. 6B pivoted about a second axis, and FIG. 6D illustrates the fixture from FIG. 6C pivoted about a third axis.

FIG. 7A illustrates an assembled perspective view and FIG. 7B illustrates a partially exploded perspective view.

DETAILED DESCRIPTION OF EXEMPLARY EMBODIMENTS

A. Overview

Figure 1A:
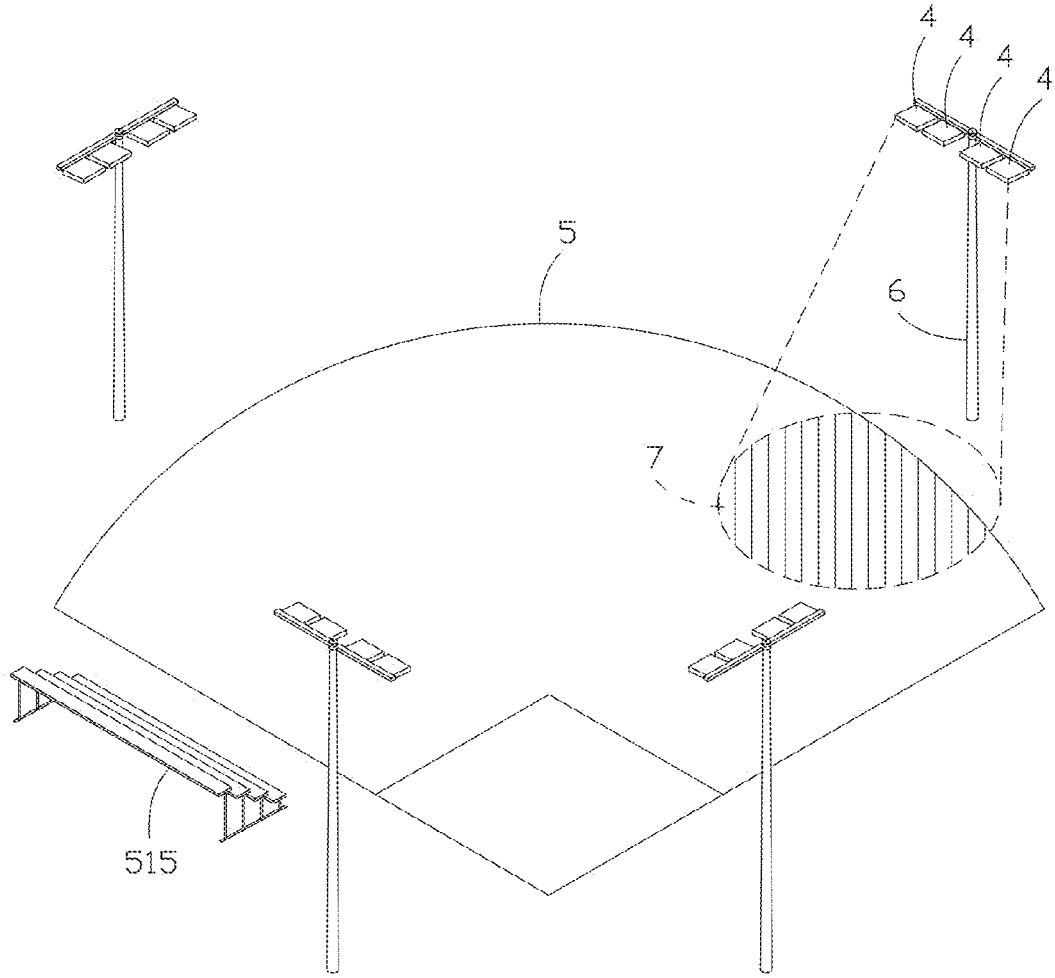
FIGS. 1A-C diagrammatically illustrate the general process by which a target area is illuminated by a lighting fixture.
Figure 1B:
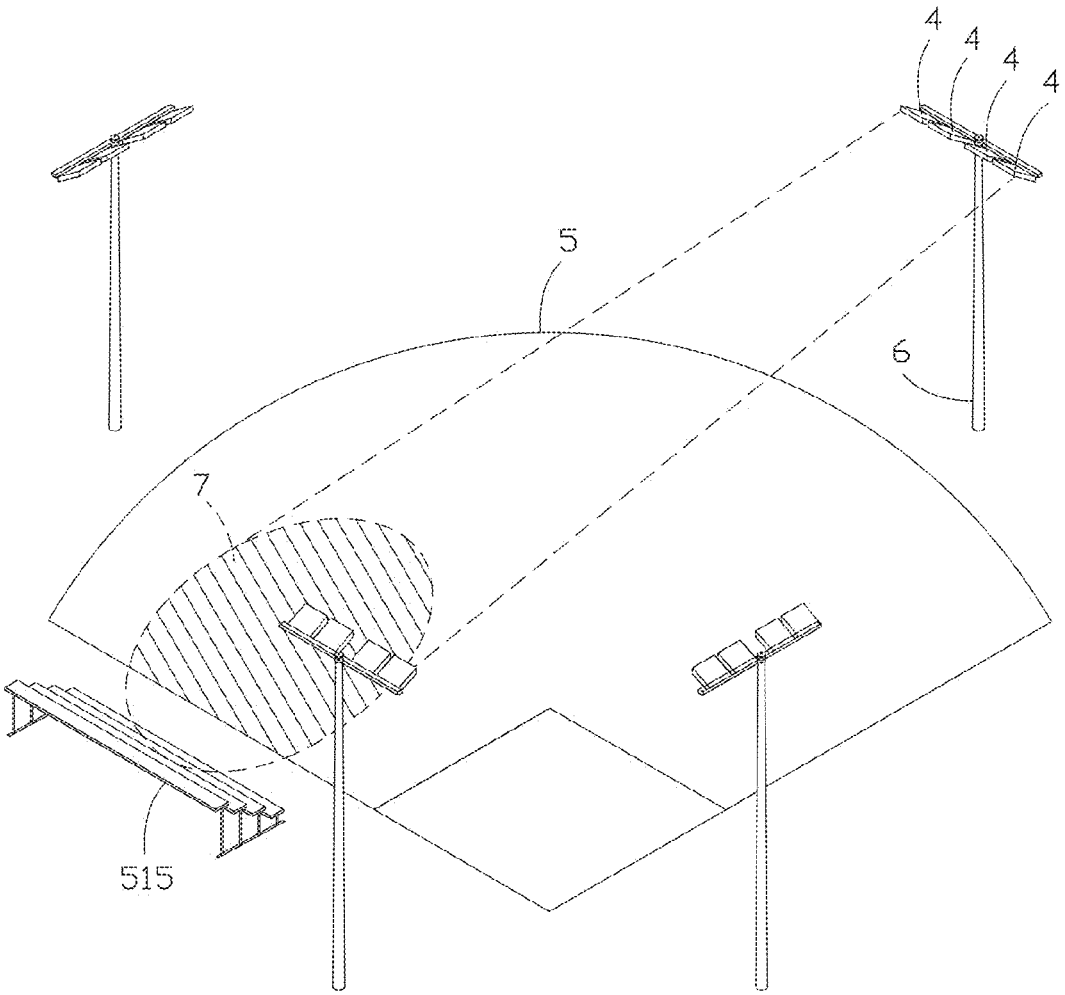
Figure 1C:
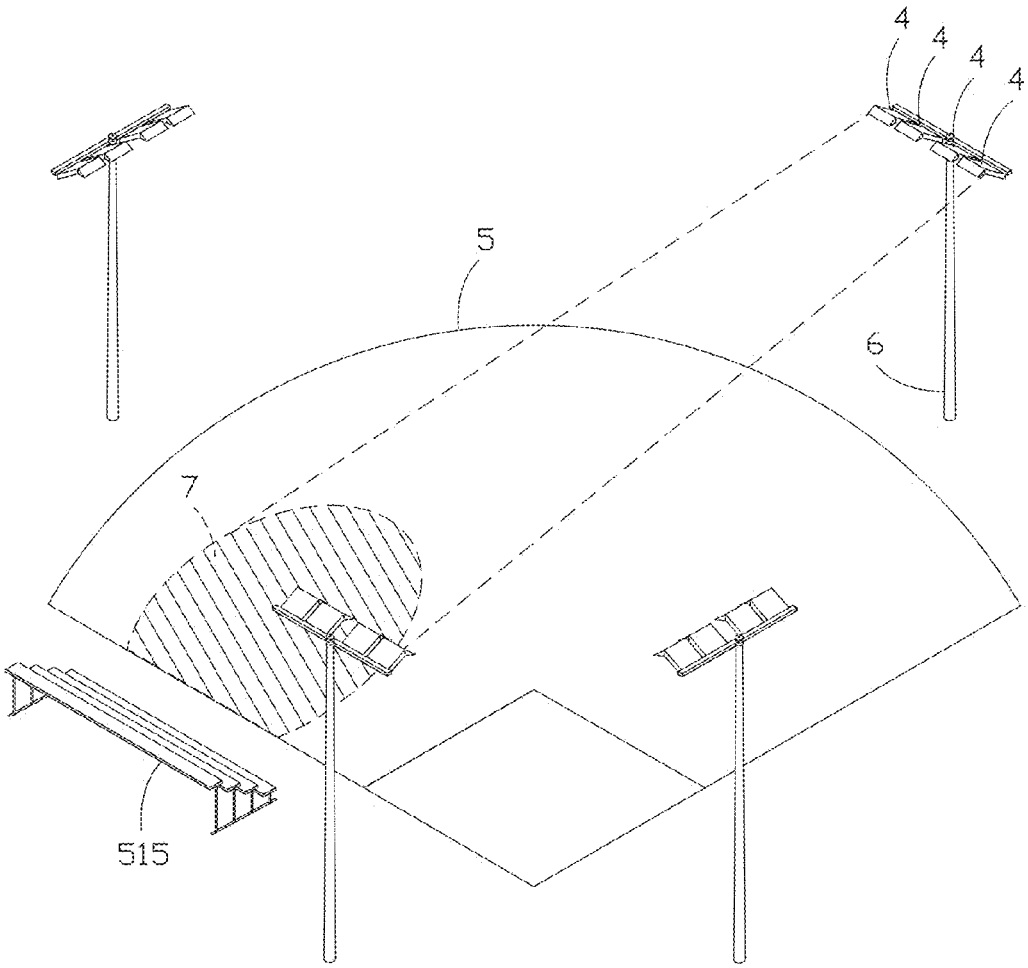

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Specific exemplary embodiments make reference to floodlight-type fixtures for sports lighting applications; this is by way of example and not by way of limitation. For example, other wide area lighting applications which compared to sports lighting applications typically require a lower overall light level (e.g., 3 horizontal footcandles (fc) versus 50 horizontal fc), lower lighting uniformity (e.g., 10:1 max/min versus 2:1 max/min), and reduced setback (e.g., several feet versus tens of feet), may still benefit from at least some aspects according to the present invention. As another example, downlight-type fixtures (e.g., ones which are not typically angled or pivoted relative to their poles) may still benefit from at least some aspects according to the present invention. As yet another example, floodlight-type fixtures which are not elevated and used for sports lighting (e.g., ground mounted floodlight-type fixtures used for façade lighting) may still benefit from at least some aspects according to the present invention.

B. Exemplary Method and Apparatus Embodiment 1

A specific example of the aforementioned modular apparatus is illustrated in FIGS. 2A-7B. With regards to FIGS. 2A-F, modular apparatus 12 may generally be understood as comprising a housing 22 which is formed to receive both a visor 23 and an enclosure 24, the latter of which is adapted to house a plurality of light sources 27 with associated optics 28 (see, e.g., FIG. 3A). An outer lens 29 seals against the open face of enclosure 24 (see FIG. 2F)—e.g., by gluing or taping—so to protect the light sources against dust, vandalism, or other undesirables and, if desired, may include an anti-reflection coating so to preserve transmission efficiency.

Figure 2A:
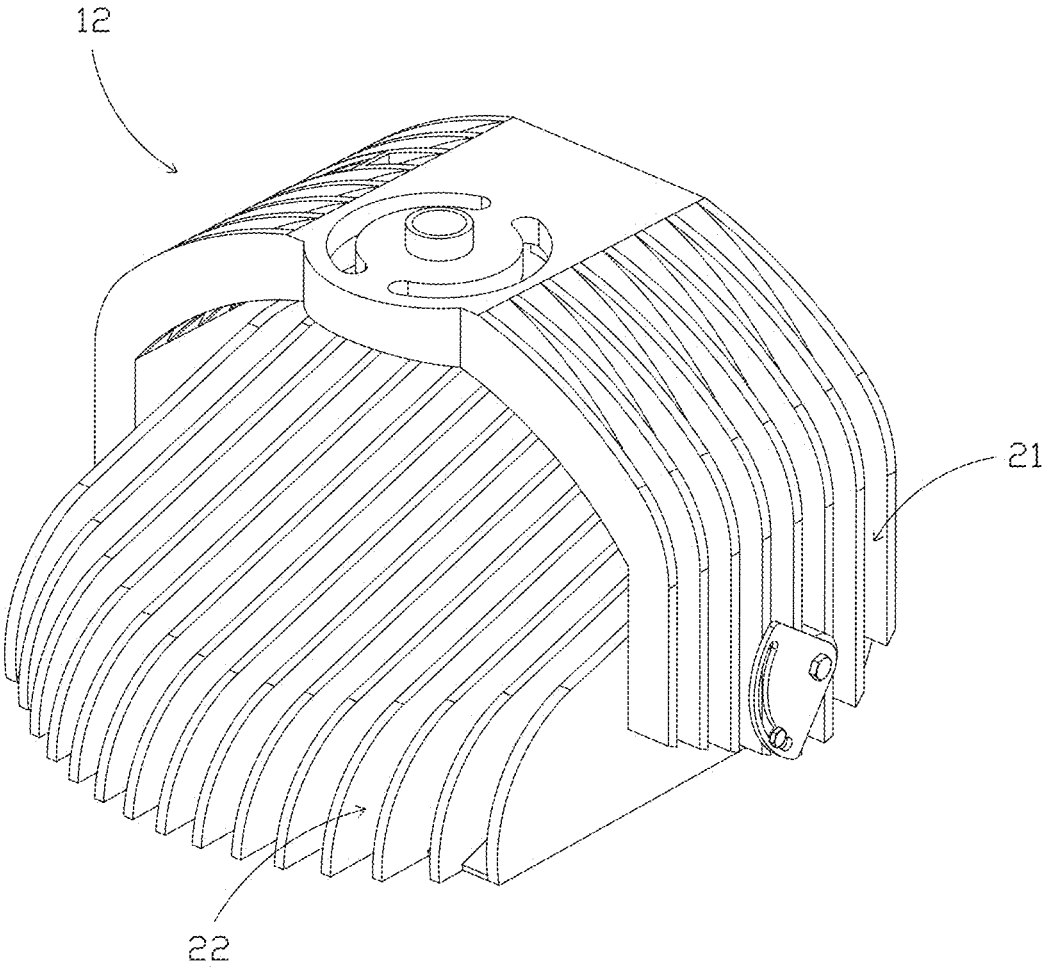
FIGS. 2A-F illustrate multiple views of a modular apparatus according to aspects of the present invention.
Figure 2B:
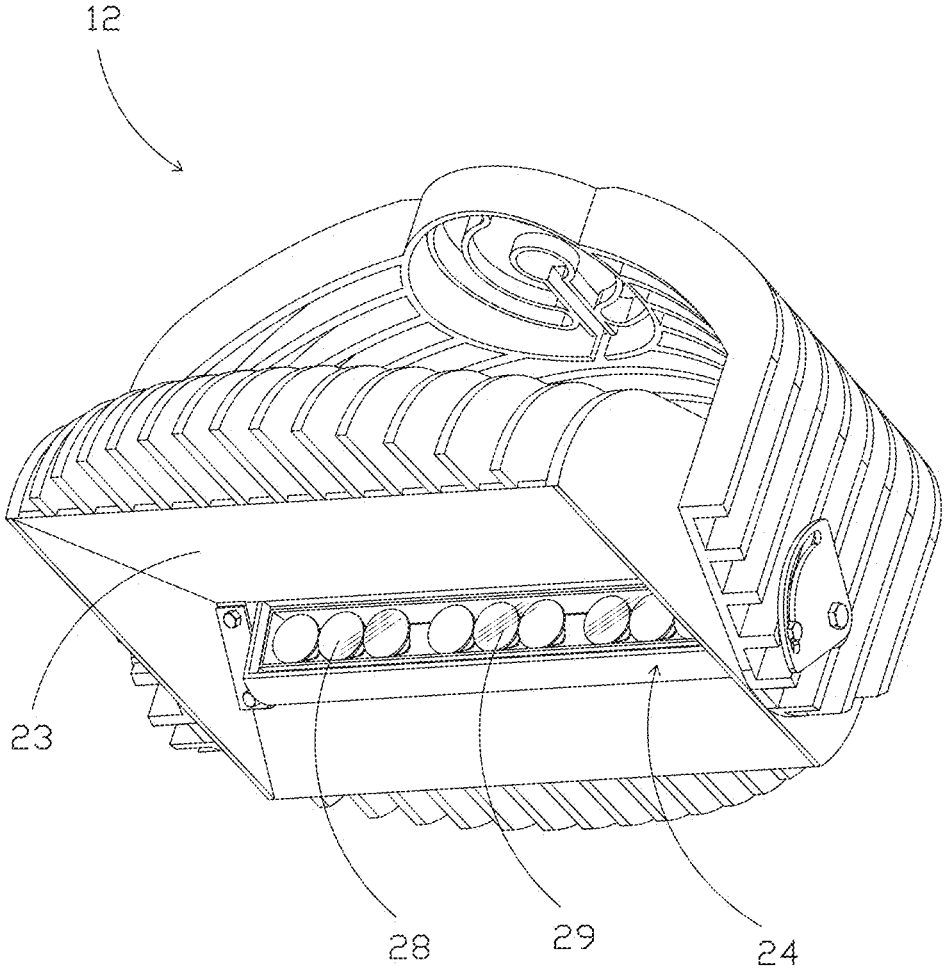
Figure 2C:
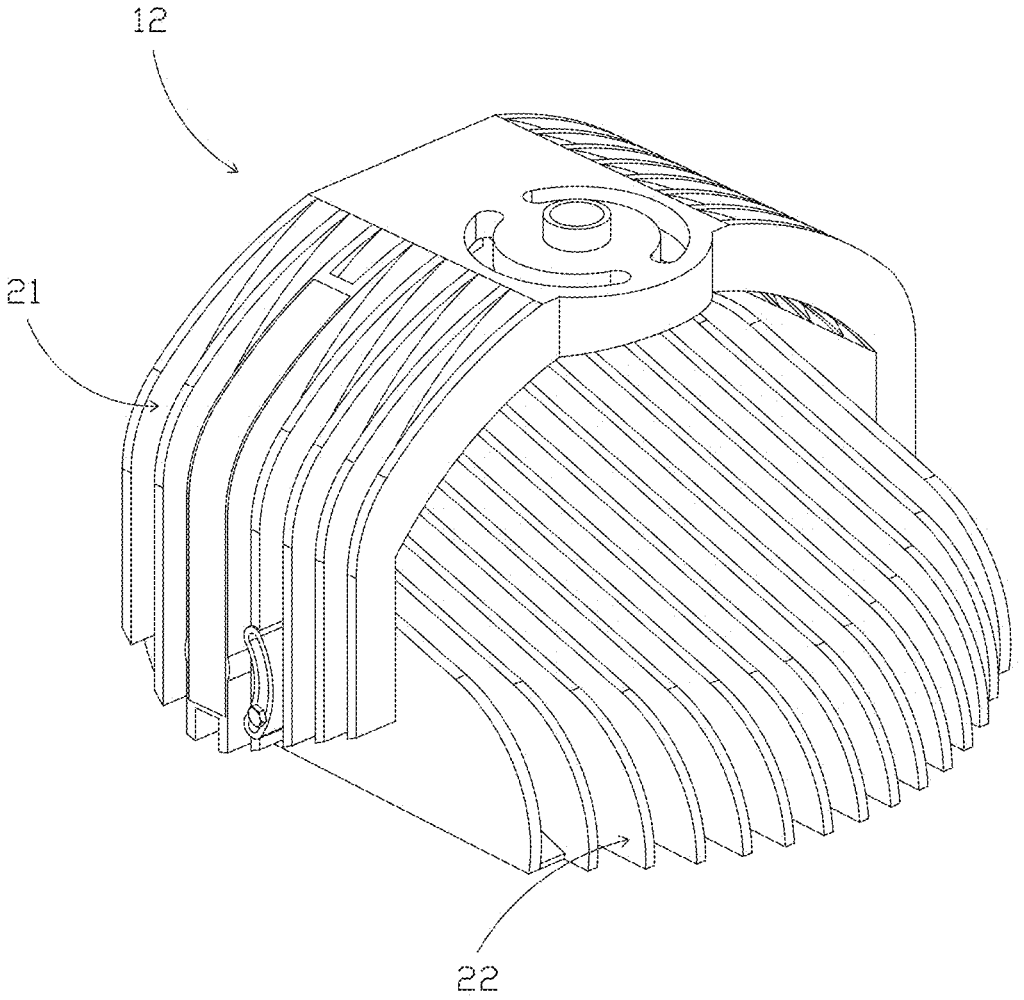
Figure 2D:
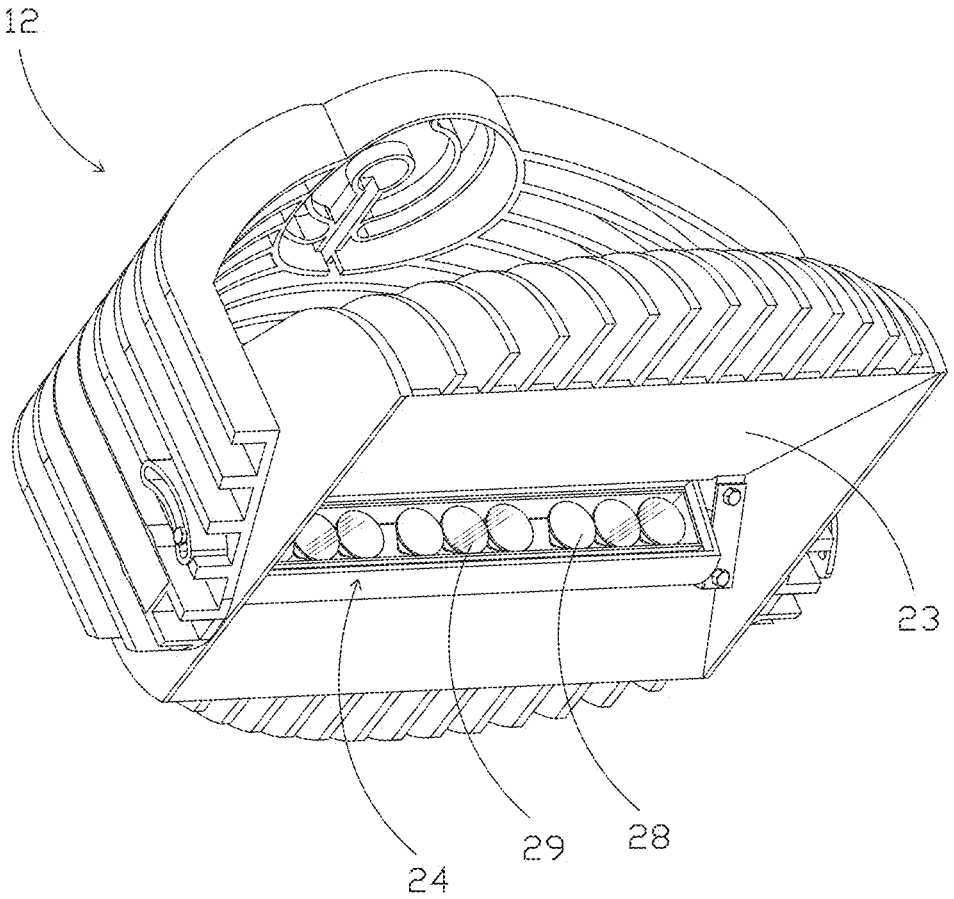
Figure 2E:
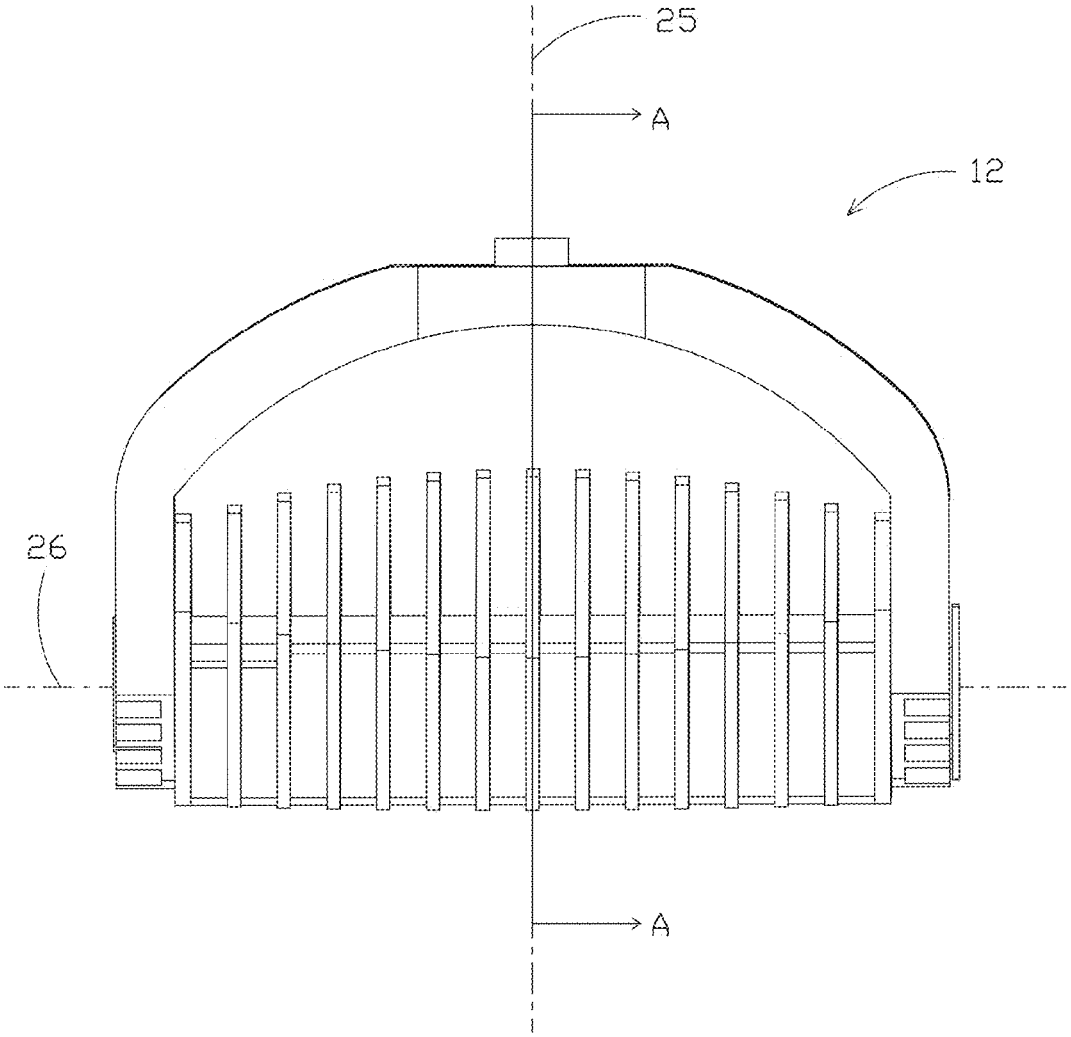
Figure 2F:
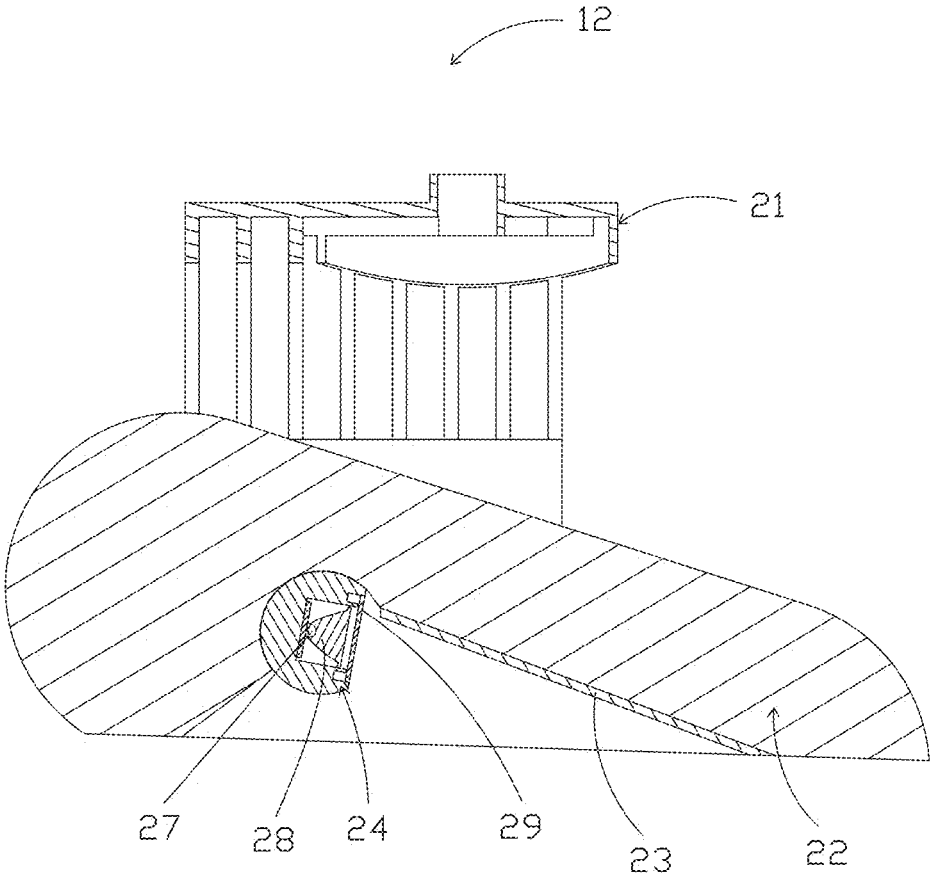

Visor 23 is formed from a highly reflective material (e.g., aluminum processed to high reflectivity) and is affixed to the inner surface (i.e., the non-finned surface) of housing 22; see FIG. 2F. It is of note that visor 23 may be bolted, glued, or otherwise affixed directly to the inner surface of housing 22 or may be bolted, glued or otherwise affixed to a frame which is further affixed to the inner surface of housing 22; an example of a reflective material affixed to a frame which is further affixed to a housing for use as a visor is discussed in aforementioned U.S. Pat. No. 7,789,540. Alternatively, the inner surface of housing 22 could be metallized (e.g., via dipping, painting, chemical deposition, sputtering, etc.) so to achieve the desired finish. The exact shape of visor 23 may vary depending on the needs of the application, and the material may be processed (e.g., peened) or otherwise modified (e.g., polished) so to produce a desired lighting effect (e.g., to produce diffuse reflection as opposed to specular reflection).

In this embodiment, enclosure 24 houses nine multi-chip LEDs 27 with nine associated optics or lenses 28 such as is discussed in U.S. Provisional Patent Application No. 61/539,166, now U.S. Pat. No. 8,866,406, incorporated by reference herein—most likely in the "quad" formation illustrated in FIG. 6 of the aforementioned application—though this is by way of example and not by way of limitation. For example, enclosure 24 could house nine model XML. LEDs available from Cree, Inc., Durham, NC, USA and nine narrow beam lenses (e.g., similar to model FC-N2-XR79-OR available from Fraen Corporation, Reading, MA, USA). Of course, other models of LEDs, types of light sources, and number of light source are possible, and envisioned. Likewise, optics 28 could comprise lenses designed to project light in any manner of distribution. (e.g., medium, elliptical, side emitting, bubble, etc.) and may take other forms (e.g., reflectors) or include additional provisions (e.g., diffusers, color gels, etc.) so to provide adequate light directing and/or light redirecting means to achieve a desired lighting effect. Optics 28 may be glued, bolted, or otherwise affixed to the circuit board of light sources 27; alternatively, optics 28 may be positionally affixed via a holder (e.g., such as commonly provided by the manufacturer) or held in compression such as is described in U.S. patent application Ser. No. 12/751,519, now U.S. Pat. No. 8,449,144, incorporated by reference herein. Ultimately, one must balance the cost and size of each modular apparatus 12 against the needed light level and uniformity at the target area; for sports lighting applications which require a higher overall light level than other wide area lighting applications, multi-Chip LEDs (with associated optics) may be needed to prove a competitive alternative to more traditional light sources such as the aforementioned high wattage HID lamps.

Figure 3A:
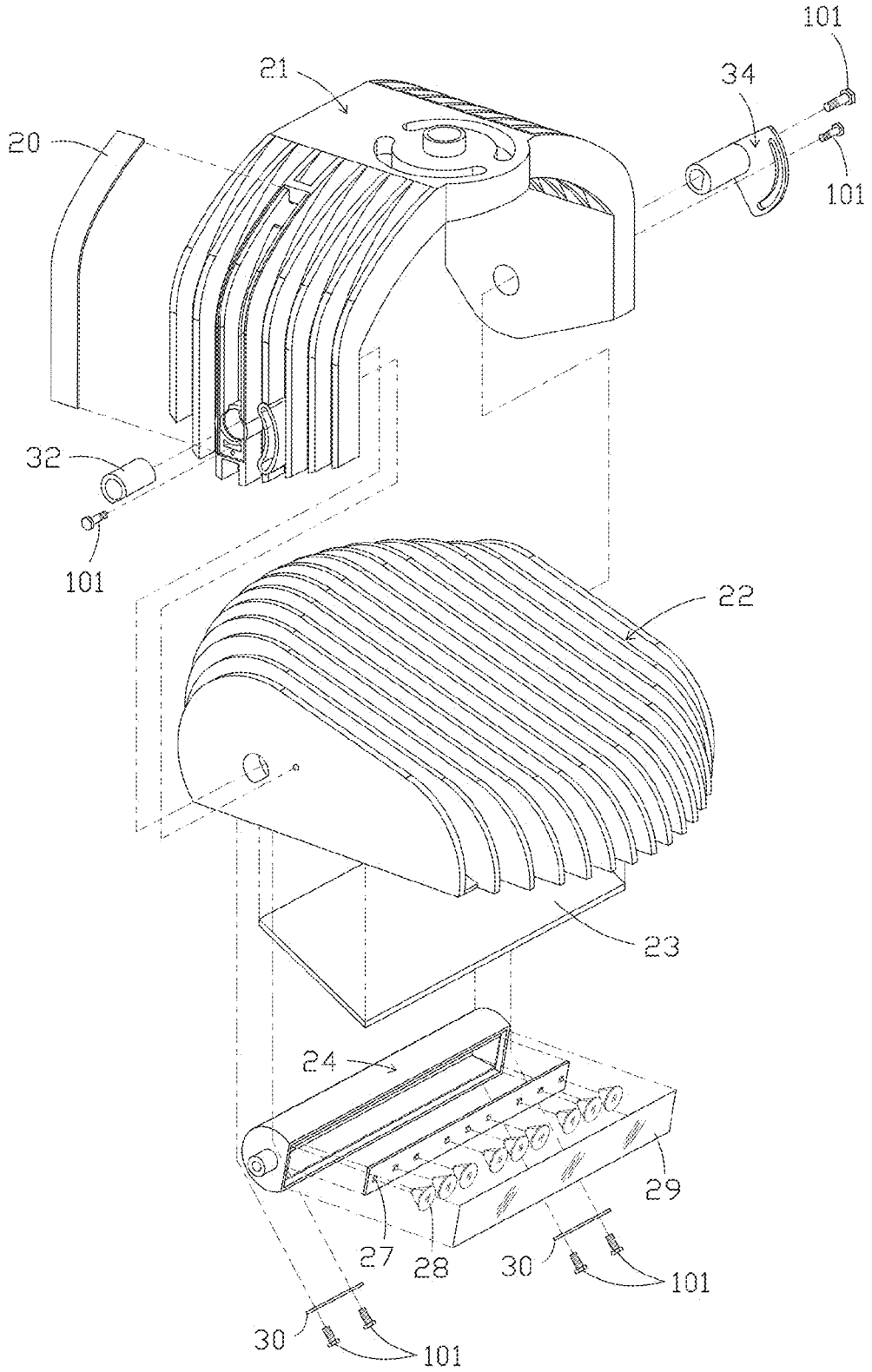
FIGS. 3A and B illustrate multiple exploded perspective views of the modular apparatus illustrated in FIGS. 2A-F.
Figure 3B:
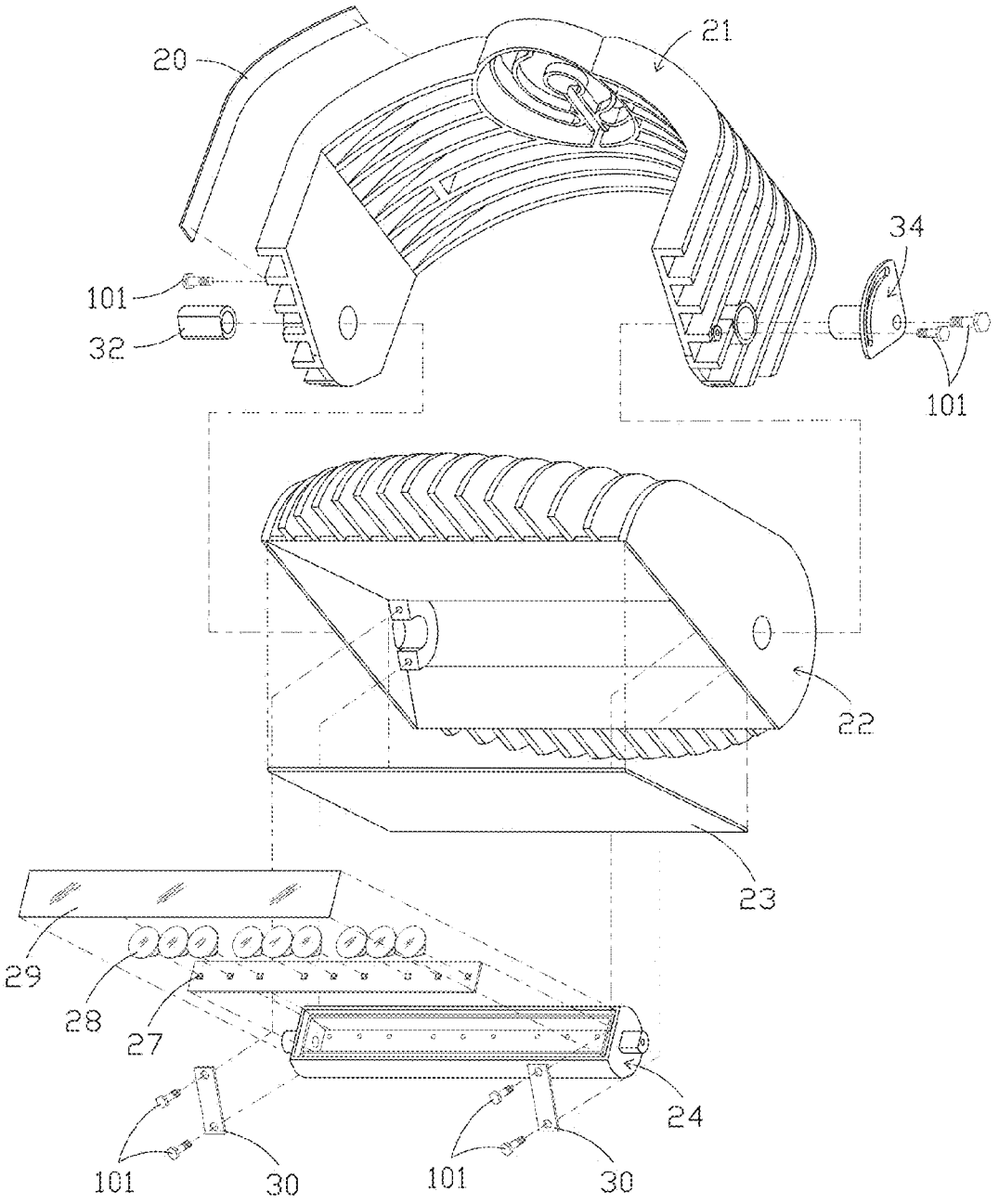

Housing 22 is suspended in a yoke 21 in a manner which allows for pivoting of enclosure 24 (and therefore, LEDs 27) and housing 22 (and therefore, visor 23) independently of each other about axis 26 (see FIG. 2E); one possible method of constructing the modular apparatus so to achieve this is illustrated in FIGS. 3A and B. Enclosure 24 is seated in a complementary groove in housing 22 (see FIGS. 2F and 3B) and positionally affixed via plates 30 and associated threaded fasteners 101 in a manner that confines enclosure 24 to its groove in housing 22 but does not prevent pivoting of enclosure 24 via pivot axis 26 (which extends along the length of enclosure 24—see FIG. 2E). Part 34, which is inserted through yoke 21 and housing 22 into a complementary end of enclosure 24 defines the degree of independent pivoting of enclosure 24 by the length of the arcuate aperture in part 34; in this example, permitting a rotation of 0-45°, though this is by way of example and not by way of limitation. The complementary end of enclosure 24 is mostly a cylindrical blind bore with a corresponding flat. Thus, when part 34 slides over the complementary end of enclosure 24, they are fixed together by fastener 101 (into the threaded bore in the complementary end of enclosure 24) and rotate together. When a desired rotational position (i.e., aiming angle) of enclosure 24 is achieved, further pivoting may be preventing by setting a threaded fastener 101 in said arcuate aperture and tightening said threaded fastener into a threaded bore in the side of yoke 21. In a similar fashion, housing 22 is positionally affixed between the arms of yoke 21 via bushing 32 and part 34 in a manner that does not prevent pivoting of housing 22 via pivot axis 26 (which extends transversely through housing 22). Bushing 32 has a flat outer lateral side which mates into a side opening with flat side in the wall of housing 22; thus, bushing 32 rotates with housing 22. Independent pivoting of housing 22 is defined by the length of the arcuate aperture in yoke 21 (see left side on FIG. 3A); a threaded fastener 101 is tightened through the arcuate aperture of yoke 21 into a threaded bore in the left side of housing 22 to clamp housing 22 in its rotational position. In this example, a housing 22 rotation of 0-45° is permitted, though this is by way of example and not by way of limitation.

Figure 4A:
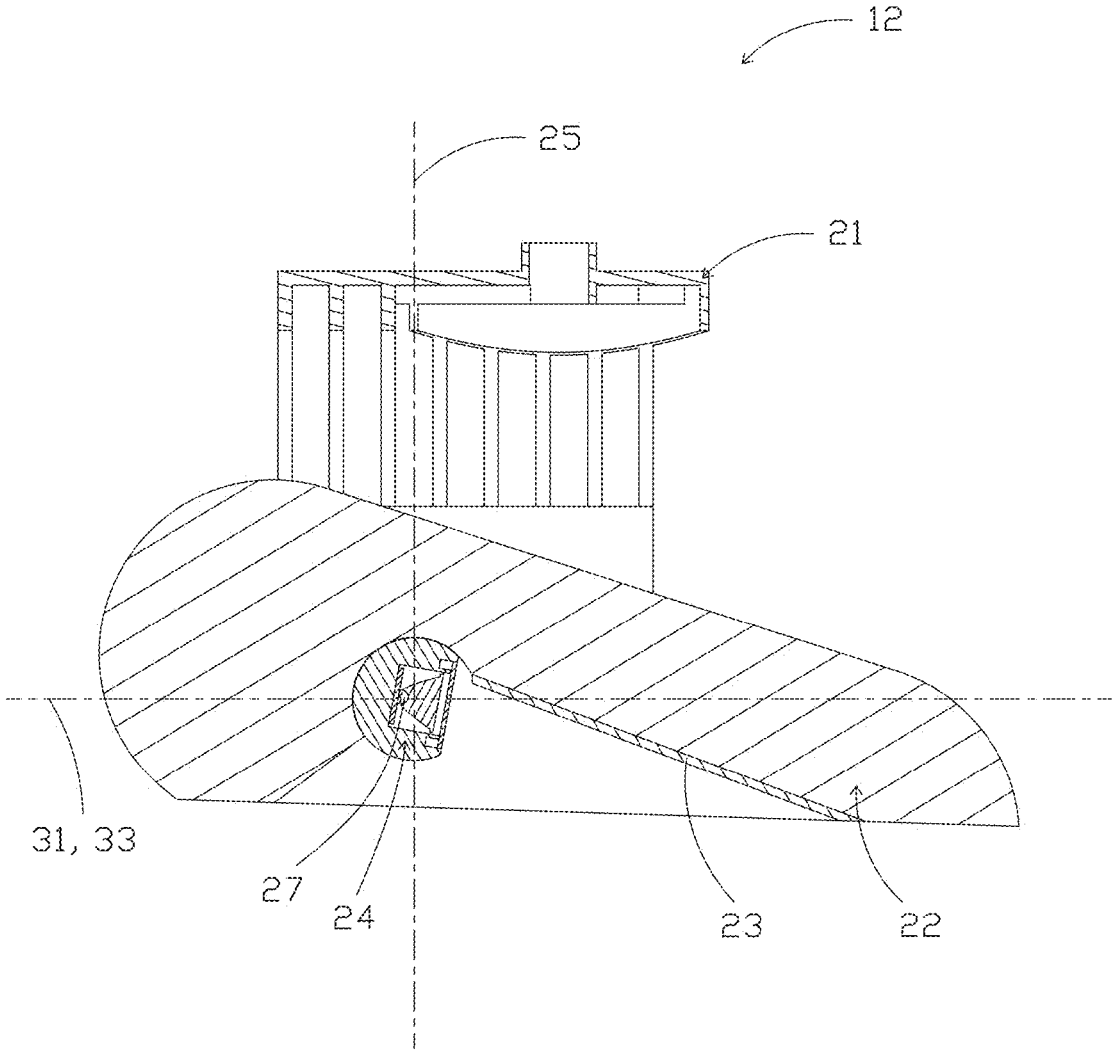
FIGS. 4A-C illustrate section A-A of the modular apparatus of FIG. 2F in the un-aimed state (FIG. 4A) and after independent pivoting (FIGS. 4B and C).
Figure 4B:
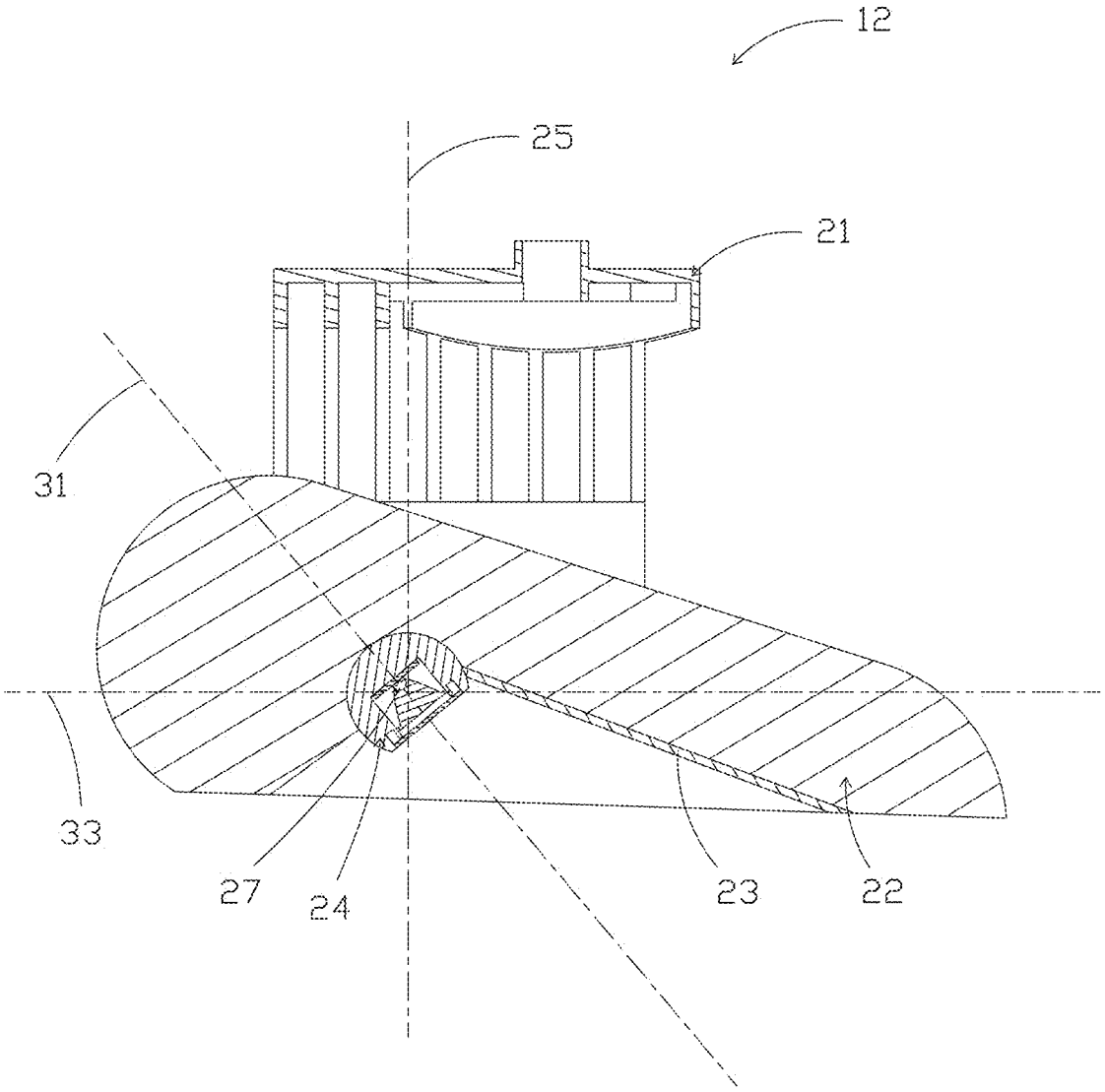
Figure 4C:
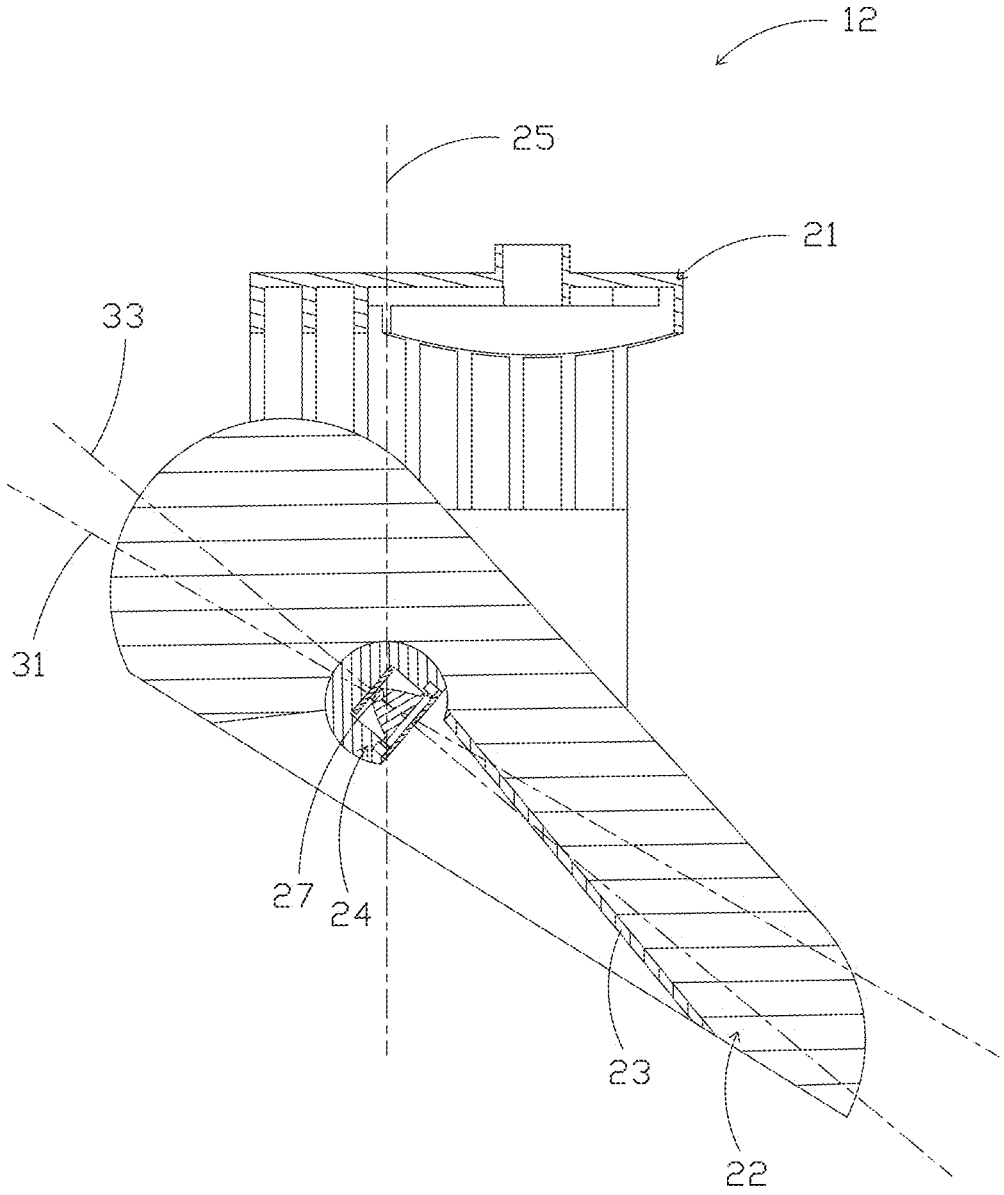

Independent pivoting of enclosure 24 and housing 22 so to achieve independent light directing and light redirecting steps is diagrammatically illustrated in FIGS. 4A-C; for clarity, FIGS. 4A-C illustrate modular apparatus 12 as taken along cut line A-A of FIG. 2E. FIG. 4A illustrates a first state wherein the composite of light projected from each LED 27 in enclosure 24 forms a beam generally centered around a principal axis 31 which coincides with principal axis 33 of housing 22, both of which are perpendicular to pivot axis 25. Assuming the overall length of visor 23 to be on the order of several inches and an angular offset from axis 33 on the order of a few degrees, the cutoff angle in this first state is on the order of 6°; cutoff angle, as described herein, is defined as the angle between principal axis 31 and visor 23. Pivoting of enclosure 24 about pivot axis 26 results in rotation of principal axis 31 (see FIG. 4B); this results in increasing the cutoff angle (e.g., up to approximately 35°) and movement of the composite beam across the target area (i.e., light directing). Pivoting of housing 22 about pivot axis 26 results in rotation of principal axis 33 (see FIG. 4C); this results in cutting off and redirecting light projected from LEDs 27 and changing the shape of the beam pattern at the target area (i.e., light redirecting). An aspect of pivoting both enclosure 24 and housing 22 about the same point is such that the size of the fixture remains compact and the EPA remains low regardless of the cutoff angle or the degree to which light is directed or redirected. Further, the use of a reflective visor 23 allows one to provide a distinct cutoff without sacrificing efficiency (as light is reflected rather than absorbed).

Both enclosure 24 and housing 22 may be further adjusted about a second axis 25 (see FIG. 2E) via pivoting of yoke 21 about its connection point to an envisioned lighting fixture 10 (see FIGS. 5A - D); said connection point and means of affixing a modular apparatus therefrom may be as described in U.S. patent application Ser. No. 12/910,443 incorporated by reference herein. In this embodiment, fixture 10 includes a center-mounted tubular portion 11 which slip-fits over a pole 6 or other elevating structure; structural members 13 help to stabilize and center fixture 10 on pole 6. To ensure suitability for outdoor use, wiring from LEDs 27 may be routed out enclosure 24 into bushing 32, along a channel in the exterior of yoke 21 (see FIG. 3A), into the interior of yoke 21, and up into fixture 10 via the top central circular aperture in yoke 21 (see FIG. 3B); a protective cover 20 aids in shielding wiring from environmental effects. Wiring from each modular apparatus is then routed along the interior of arms 14, tubular portion 11, and pole 6—all of which are generally hollow until—terminating at an electrical enclosure 1. In a similar fashion, heat from LEDs 27 is dissipated through enclosure 24, housing 22, yoke 21, and into arm 14—all of which are thermally conductive (e.g., of an aluminum or aluminum alloy construction). An aspect of the design of modular apparatus 12 is such that wiring is shielded from environmental effects and a thermal dissipation path is maintained regardless of aiming and cutoff; though other designs of modular apparatus 12 are possible, and envisioned. If it is desirable to provide a more substantial heat sink for LEDs 27—as it is well known that the efficacy and life span of LEDs is adversely affected by increasing junction temperature—fixture 10 may be actively air or liquid cooled; methods of actively cooling fixture 10 may be as described in U.S. Provisional Patent Application No. 61/645,870, now U.S. Pat. No. 9,028,115 incorporated by reference herein.

If desired, a third pivot axis may be provided; this allows greater flexibility in addressing the lighting needs of a particular application, and for correction of undesired stretching or positioning of a projected beam that may result from pivoting about axes 25 and 26. Consider again a field 5 illuminated by one or more fixtures 10 (see FIG. 6A); in this example, assume the projected beam 7 is somewhat wide and shallow (e.g., 30°×10°) and is intended to illuminate the upper rightmost corner of field 5 (the desirable portions of beam 7 are again shown in hatching). Pivoting modular apparatus 12 about pivot axis 25 on the order of 45° shifts beam 7 towards the desired corner (see FIG. 6B) but results in rotating the beam pattern (e.g., relative bleachers 515) such that area 580 is not adequately illuminated. Pivoting housing 22 and/or enclosure 24 about pivot axis 26 on the order of 20° elongates pattern 7 (see FIG. 6C) and adequately illuminates the desired corner of target area 5, but results in spill light 510. Rotation about a third pivot axis on the order of 20°, in essence, changes the shape of beam pattern 7—as opposed to merely rotating the beam pattern as in FIG. 6B or changing the dimensions of the beam pattern as in FIG. 6C—and results in a beam pattern that adequately illuminates the desired corner of target area 5 with little spill light (see FIG. 6D). That being said, additional pivoting about axes 25 and 26 could place even more light on field 5 and further reduce spill light.

As envisioned, pivoting about a third axis may be achieved via modification of the optical components or the structural components of modular apparatus 12, though either approach has its own benefits and considerations. For example, pivoting about a third axis via modification of the optical components may be as simple as rotating lens 28 or applying a filter or diffuser to lens 28, but one must consider the type of lens being used—rotating a lens will only appreciably change a beam pattern if the lens is elliptical or otherwise asymmetric about an axis—and any loss to transmission efficiency incurred by adding materials to lens 28. Pivoting about a third axis via modification of the structural components of modular apparatus (see FIGS. 7A and B) may not restrict selection of lens types and may also permit pivoting of visor 23 (assuming this is preferable which it may not be), but may add weight and cost to fixture 10. With respect to FIGS. 7A and B, a pivot joint 120 comprises a modular apparatus mounting portion 121 and a fixture mounting portion 122 each of which has associated threaded fasteners 101 and, if desired, nuts 102. In either case—modification of optics or structural components—rotation about a third pivot axis 35 is provided and in a manner that does not impair pivoting about axes 25 and 26 and does not significantly impact the size or EPA of fixture 10.

Figure 8:
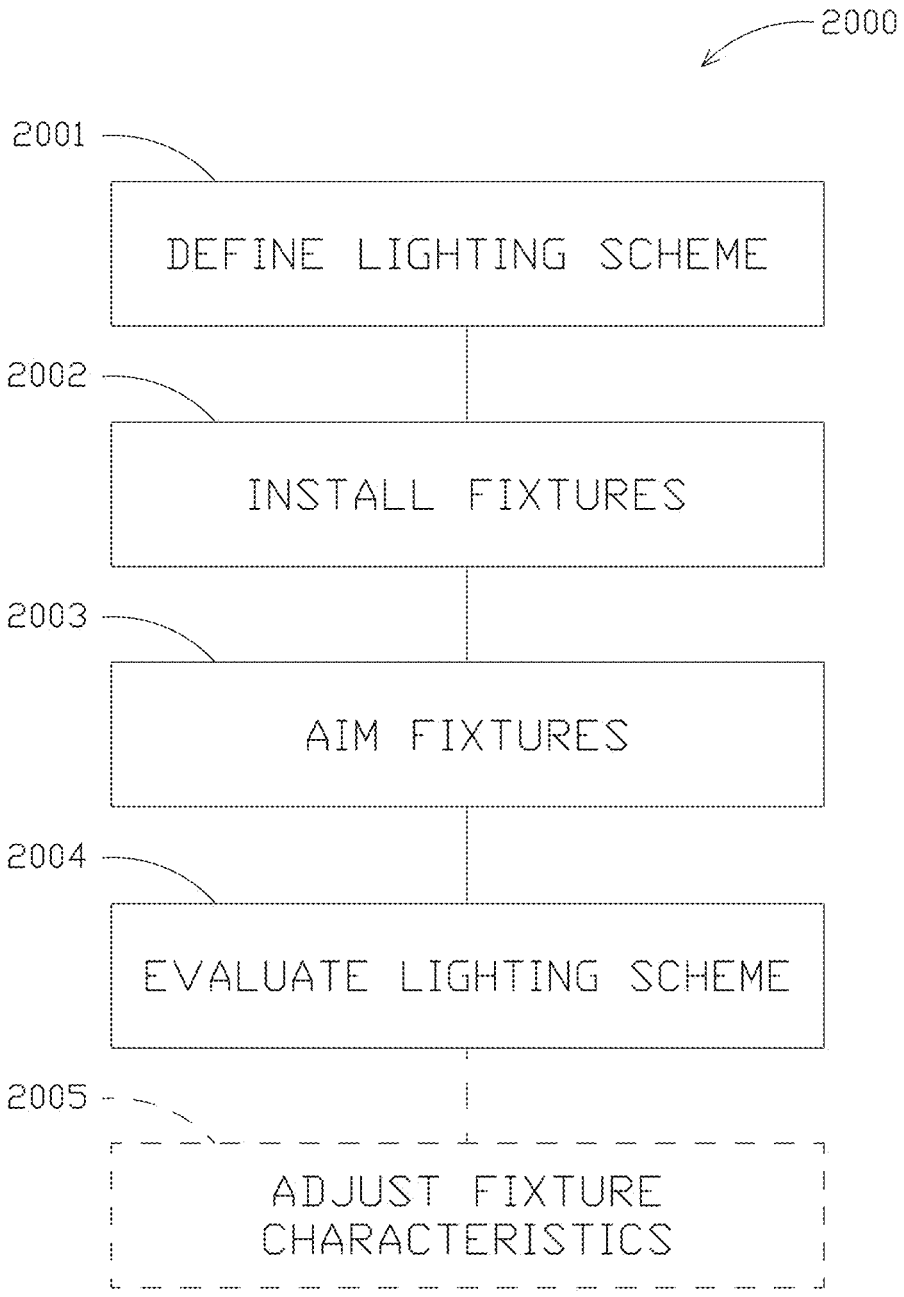
FIG. 8 illustrates in flowchart form one possible method of addressing the lighting needs of a particular application using a fixture 10 comprising a plurality of modular apparatuses 12.

A fixture 10 employing a plurality of modular apparatuses 12 such as is illustrated in FIGS. 5A-D may be adjusted about one, two, or three axes so to address the lighting needs of a particular application according to method 2000 (see FIG. 8), though other methods are possible, and envisioned. According to method 2000, a first step 2001 is to define the lighting scheme for the application; specifically, to identify any limiting factors (e.g., overall lighting uniformity, minimum light level, required setback, size and shape of the target area, etc.) and desired features (e.g., number of modular apparatuses per fixture, color temperature of LEDs, etc.) and develop an appropriate lighting scheme (also referred to as a lighting design plan or an aiming diagram). The lighting scheme may then be broken down into individual beam patterns each of which may be assigned to one or more modular apparatuses 12. A next step 2002 is to install fixtures in and/or about the identified target area in accordance with the lighting scheme. A benefit of fixture 10 is such that because it is center-mounted—note the position of tubular portion 11 in FIGS. 5A-D—modular apparatuses 12 may be aimed in any nearly any direction and avoid shadowing effects from pole 6; this may be beneficial when deciding where to place fixtures relative the target area.

A next step 2003 is to aim the installed lighting fixtures such that each modular apparatus 12 in a given lighting fixture is aimed so to produce the individual beam pattern to which it is assigned. In practice, step 2003 may comprise rotating fixtures 10 about pole 6 and/or pivoting one or more components of each modular apparatus 12 about one or more of pivot axes 25/26/35. If desired, portions of modular apparatus 12 could be labeled with degree markings or other markings well known in the art so that the lighting designer or other user could set aiming angles more precisely. A final step 2004 is to evaluate the lighting scheme and the ability of fixtures 10 to satisfy the lighting scheme. Often, a lighting designer will find that something has been unaccounted for (e.g., a tree that blocks the light from a fixture) or a customer may decide the lighting scheme is inadequate (e.g., the appearance of the lighting is too harsh or too soft); in such situations it may be necessary to adjust one or more characteristics of the fixtures (see optional step 2005). In practice, optional step 2005 may comprise adding optical components 28 to one or more modular apparatuses 12, changing the degree of pivoting (i.e., changing aiming angle) of one or more components of fixture 10, changing the shape and/or size of visor 23, adding modular apparatuses 12 to a fixture 10, adjusting operating power to LEDs 27 so to produce more or less light, changing the number or type of light sources in modular apparatuses 12, or the like.

C. Options and Alternatives

The invention may take many forms and embodiments. The foregoing examples are but a few of those. To give some sense of some options and alternatives, a few examples are given below.

Various means and methods of affixing one component to another have been discussed; most often in terms of a threaded fastener. It should be pointed out that such a device is not limited to a bolt or screw, but should be considered to encompass a variety of means of coupling parts (e.g., gluing, welding, clamping, etc.). Also discussed was a collection of modular apparatuses; referred to herein as a fixture. It should be pointed out that the term "fixture" is often used interchangeably with "luminaire" and that neither term is intended to purport any limitation not explicitly stated herein.

As envisioned, a majority of components of both fixture 10 and modular apparatus 12 are machined, punched, stamped, or otherwise formed from aluminum or aluminum alloys. As stated, this allows a distinct and uninterrupted thermal path to dissipate heat from LEDs 27. However, it is possible for said components to be formed from other materials and not depart from inventive aspects described herein, even without realizing the benefit of heat dissipation. Likewise, a majority of components in pole 6, fixture 10, and modular apparatus 12 are formed with interior channels such that wiring may be run from LEDs 27 to the bottom of pole 6 without exposing wiring to moisture or other adverse effects. However, it is possible for said components to be formed without such interior channels and not depart from inventive aspects described herein; indoor lighting applications, for example, may not require environmental protection for wiring.

Figure 9:
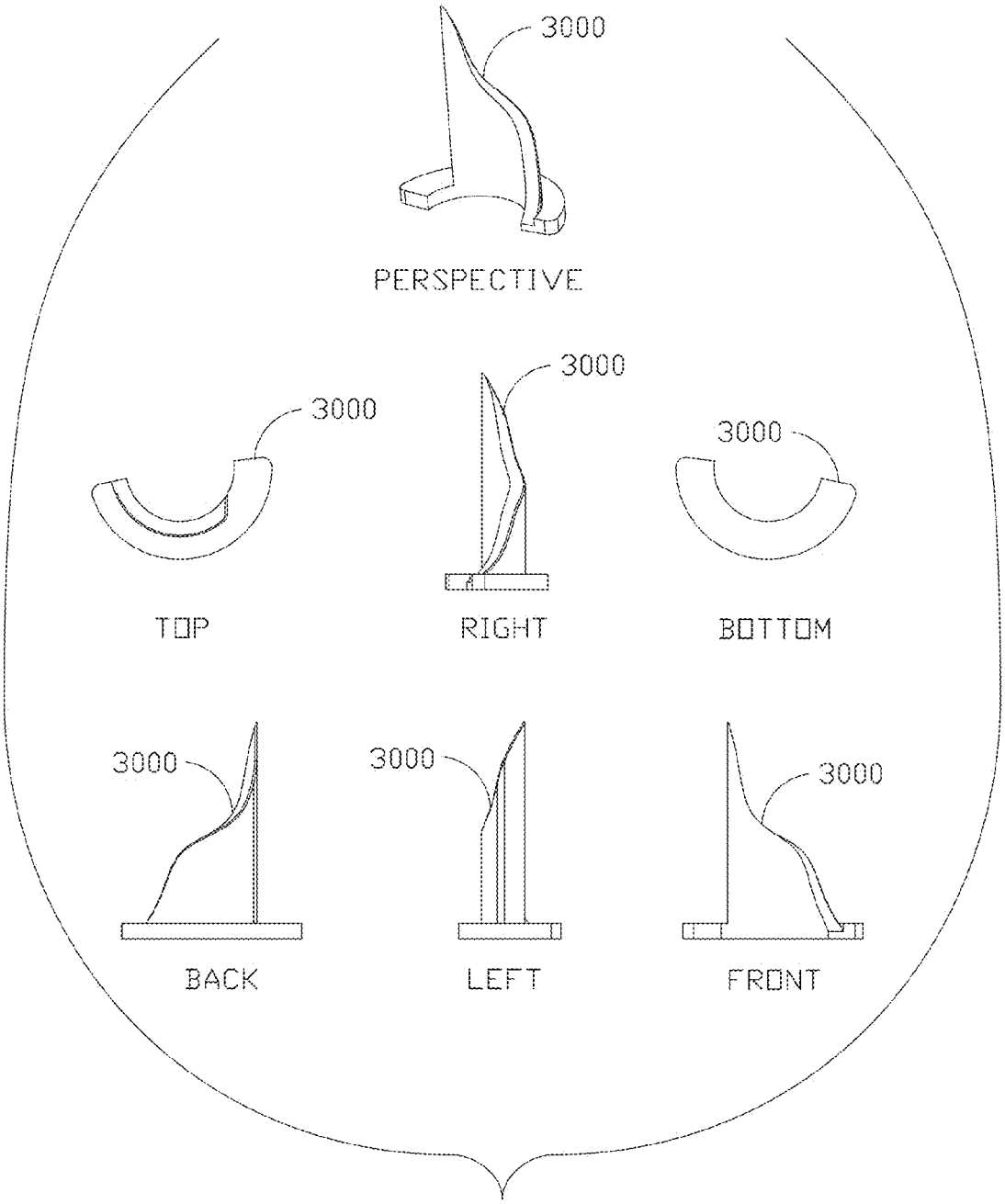
FIG. 9 illustrates one possible design of optical device for use with LEDs 27 so to prevent horizontal spread.

With regards to modular apparatus 12, several examples of devices used for light directing and light redirecting have been given; this is by way of example and not by way of limitation. While any of these devices (e.g., lenses, diffusers, reflectors, visors, etc.) could be used individually or in combination for a particular application, it should be noted that modular apparatus 12 is not restricted to any particular combination of parts, design, or method of installation, and may comprise additional devices not already described if appropriate in creating a desired lighting scheme. For example, if a target area comprises a finite space above a sports field, some number of modular apparatuses 12 could be mounted upside down to provide uplighting or the arcuate apertures in parts 21 and 34 could be elongated so to permit a greater degree of pivoting. As another example, if a lighting designer finds that the horizontal spread of a composite beam pattern is unacceptable a new lens could be used or the existing lens (assuming an asymmetric lens) could be rotated about pivot axis 35, but another solution could be to install rails (reflective or not) on the perimeter of visor 23 or otherwise modify visor 23 so to reduce horizontal spread. Alternatively, one or more light sources 27 could each include an individual reflector 3000 (see FIG. 9) which would partially surround each of said light source(s); as envisioned, at least the surface partially surrounding light source 27 would be reflective, though this is by way of example and not by way of limitation. With this alternative, the internal chamber of enclosure 24 may need to be expanded so to provide adequate clearance between the distal tip of reflectors 3000 and outer lens 29; this could limit the degree to which enclosure 24 may be pivoted. Individual reflectors 3000 may be glued, bolted, or otherwise affixed to the circuit board of light sources 27; alternatively, individual reflectors 3000 may be positionally affixed via a holder or held in compression such as is described in aforementioned U.S. Pat. No. 8,449,144.

Figure 5A:
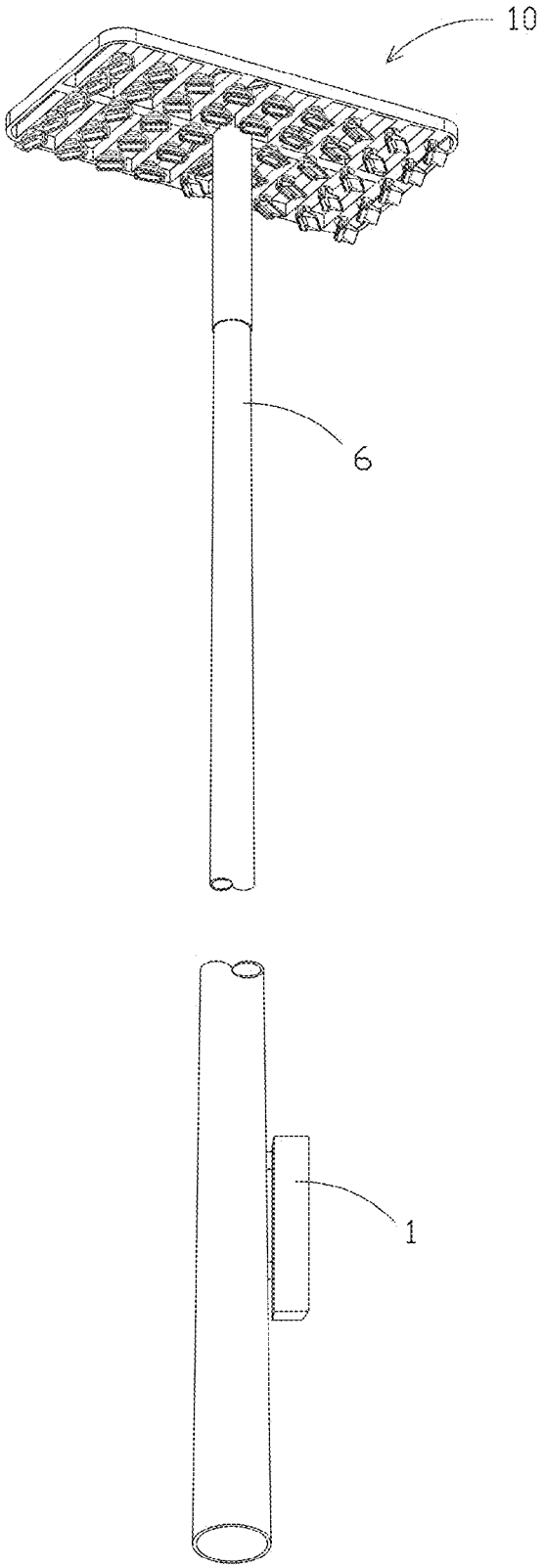
FIGS. 5A-D illustrate one possible pole and lighting fixture according to aspects of the present invention which include a plurality of the modular apparatus illustrated in FIGS. 2A-F.
Figure 5B:
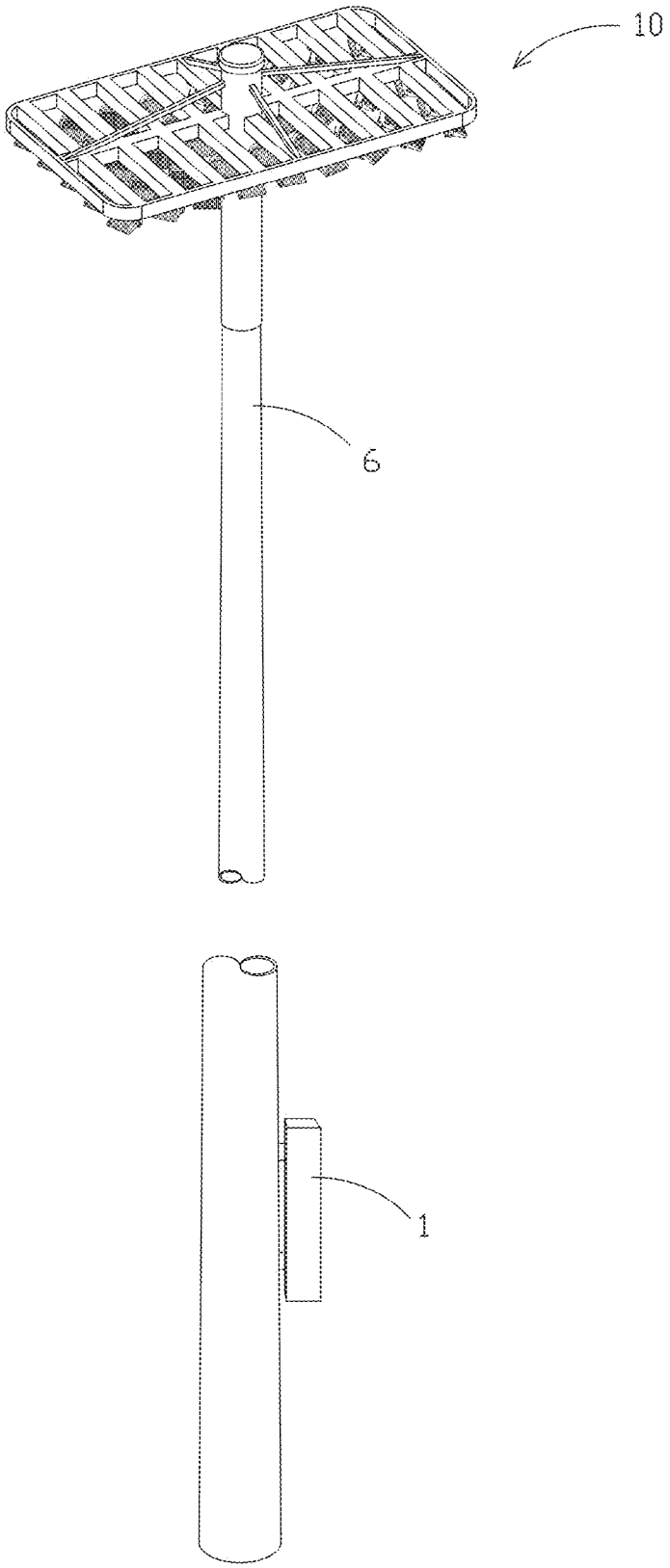
Figure 5C:
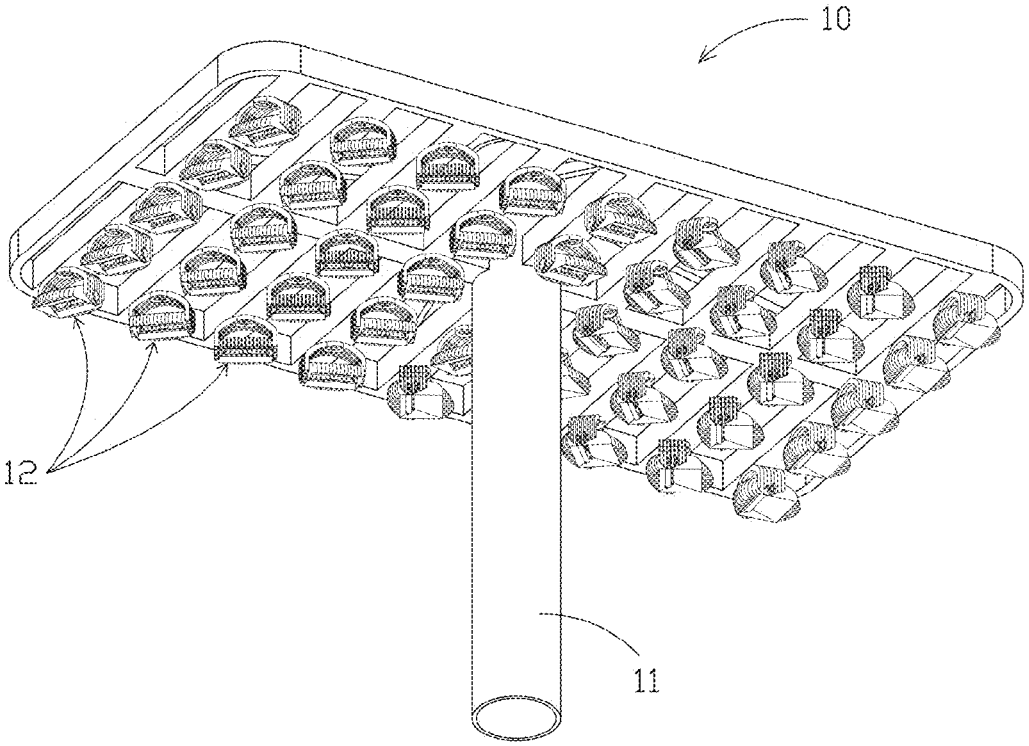
Figure 5D:
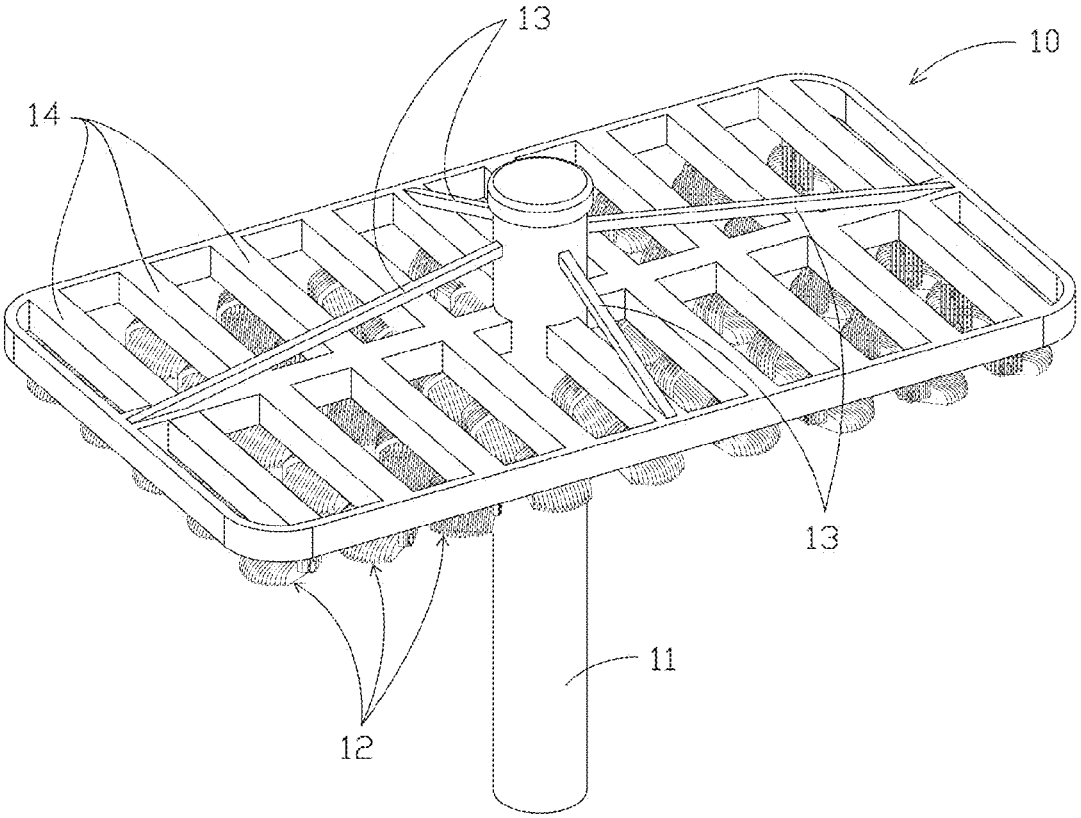
Figure 6A:
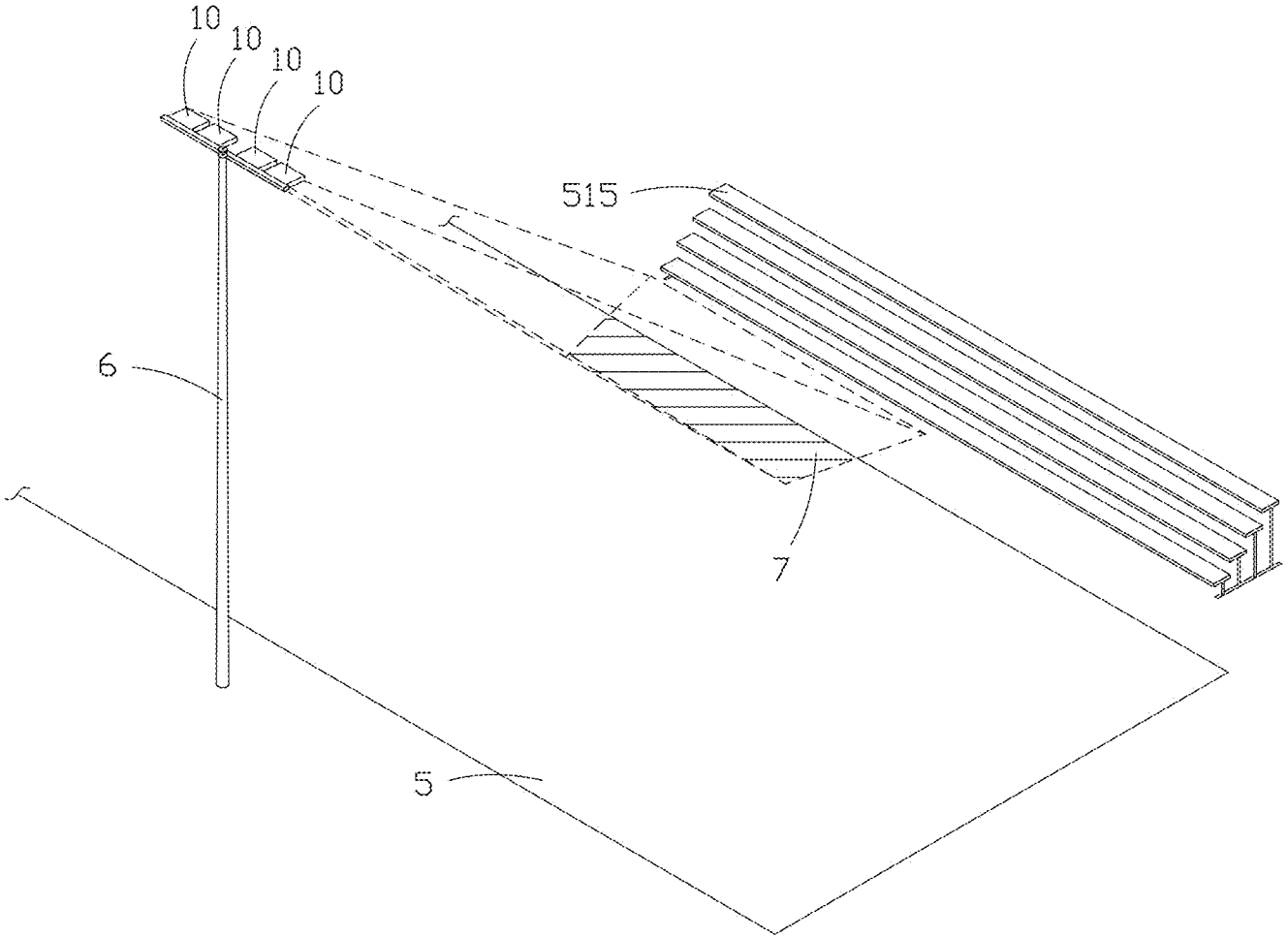
FIGS. 6A-D diagrammatically illustrate the general process by which a target area is illuminated by a lighting fixture with three-axis pivoting.
Figure 6B:
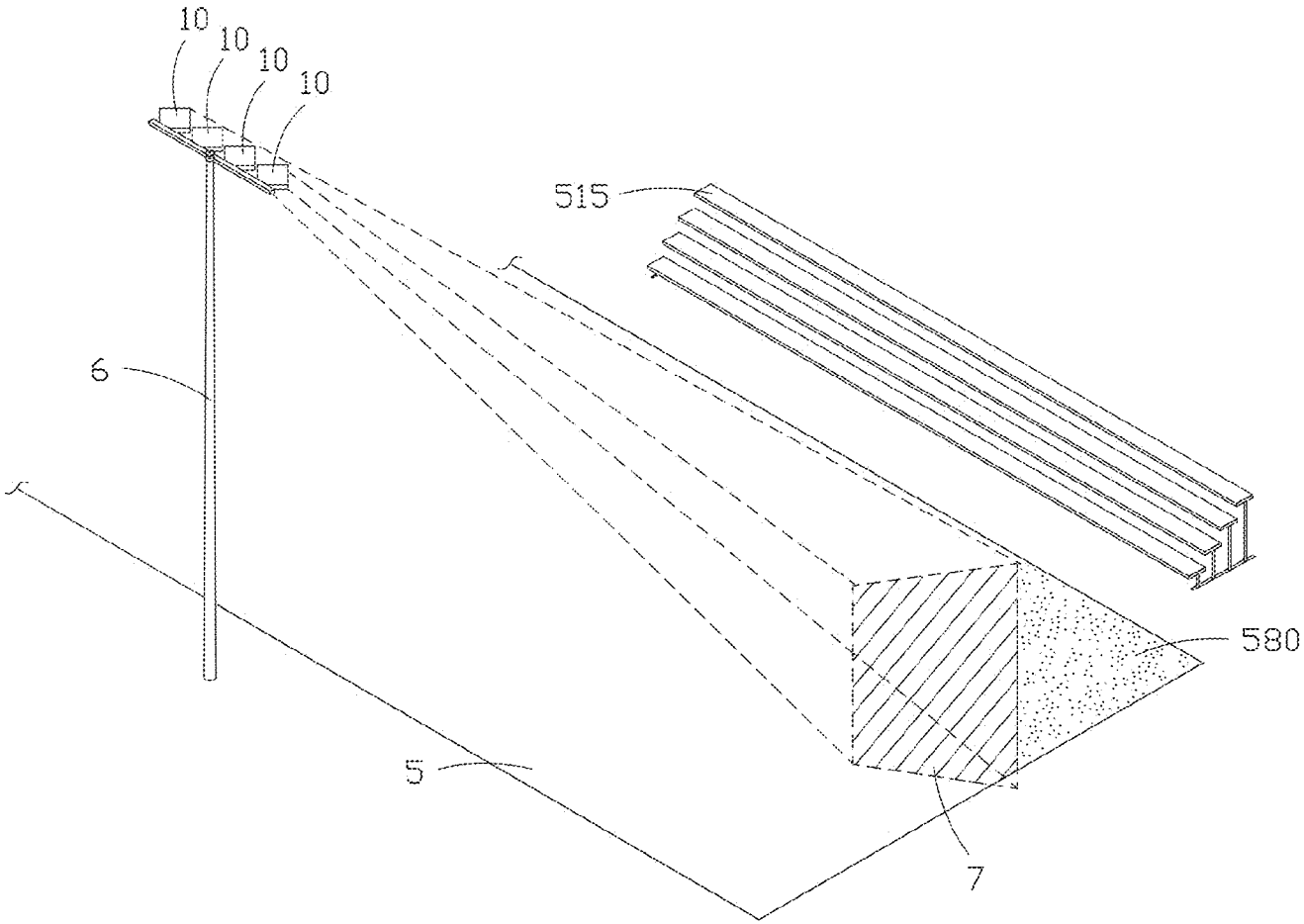
Figure 6C:
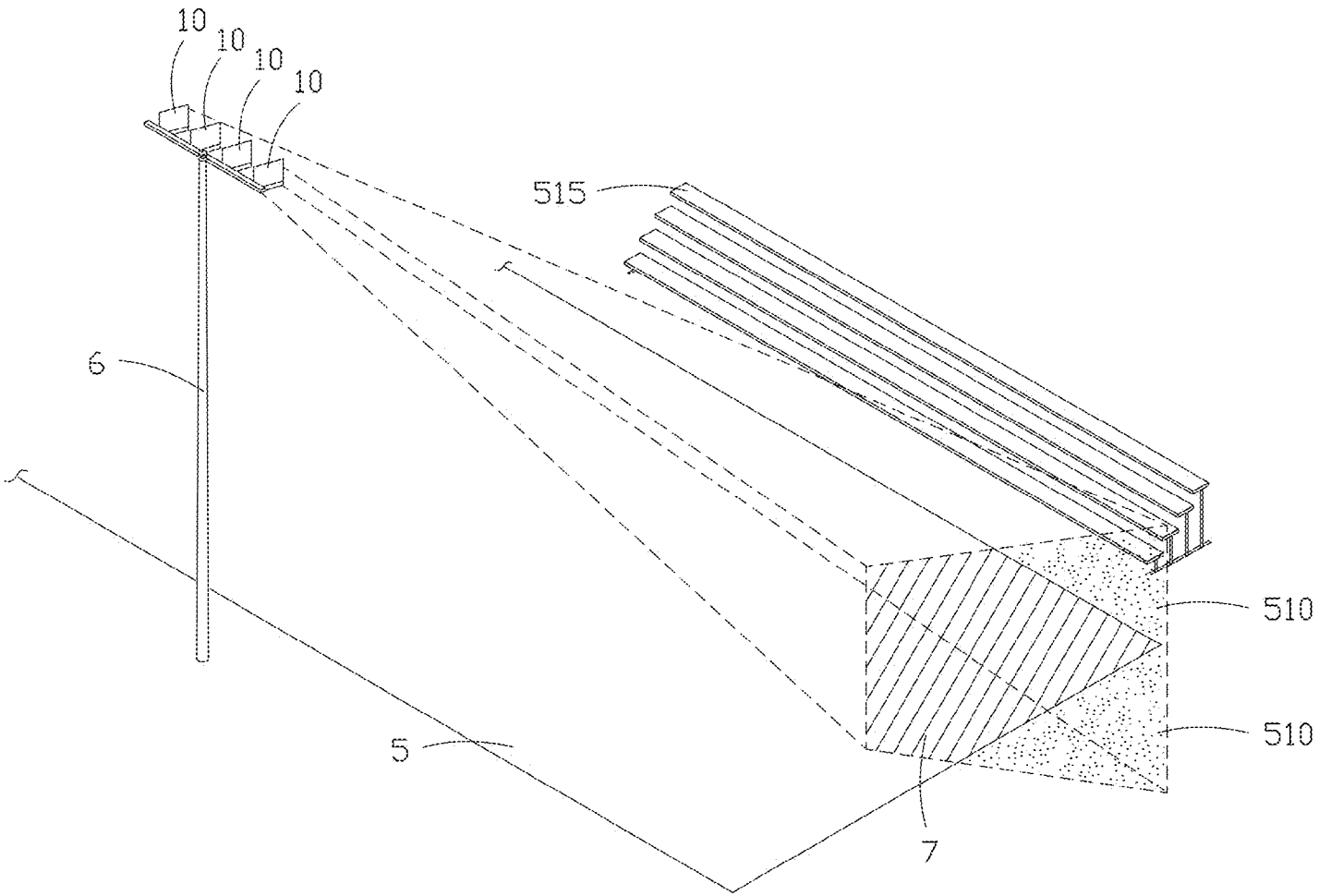
Figure 6D:
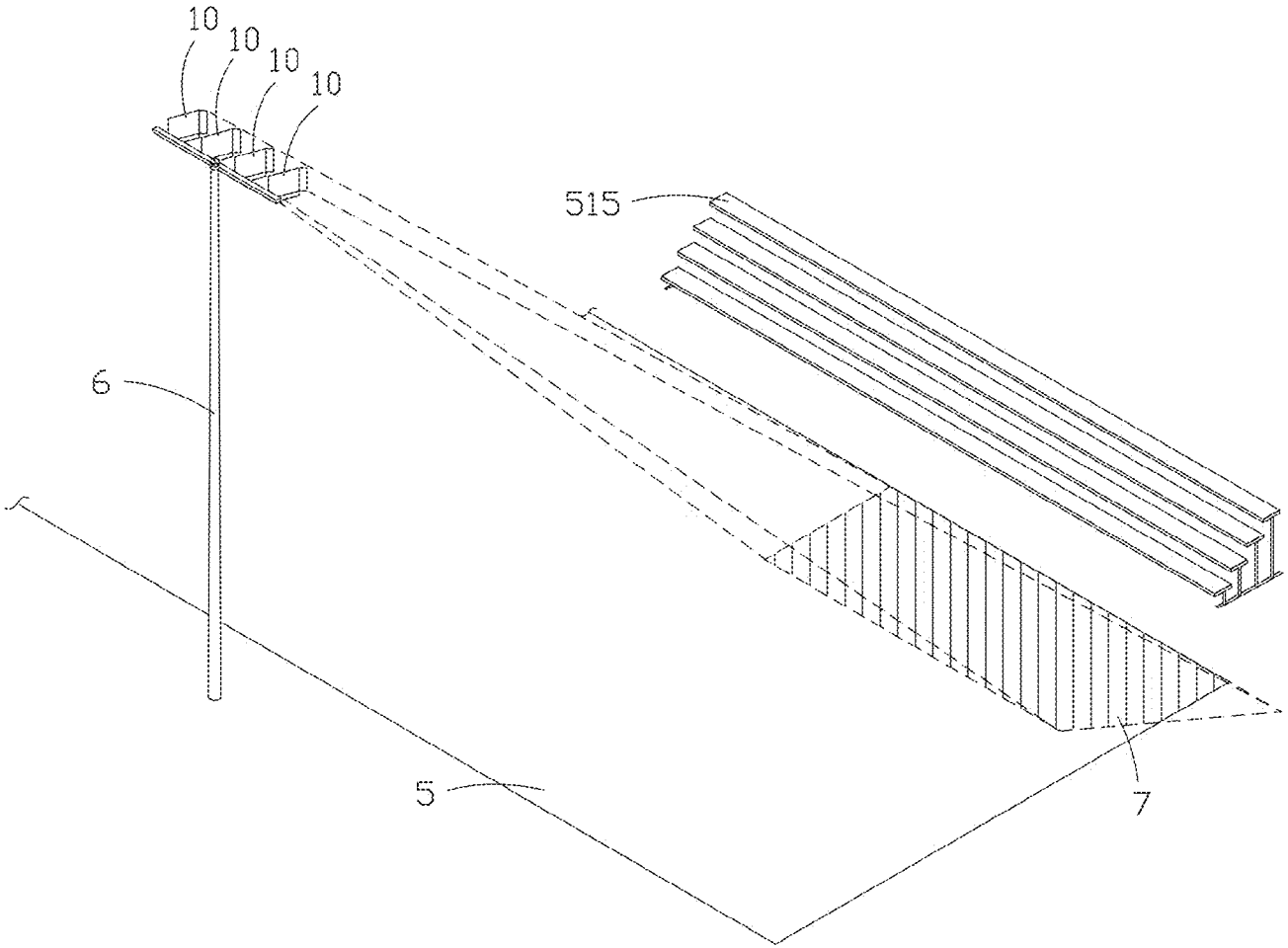
Figure 7A:
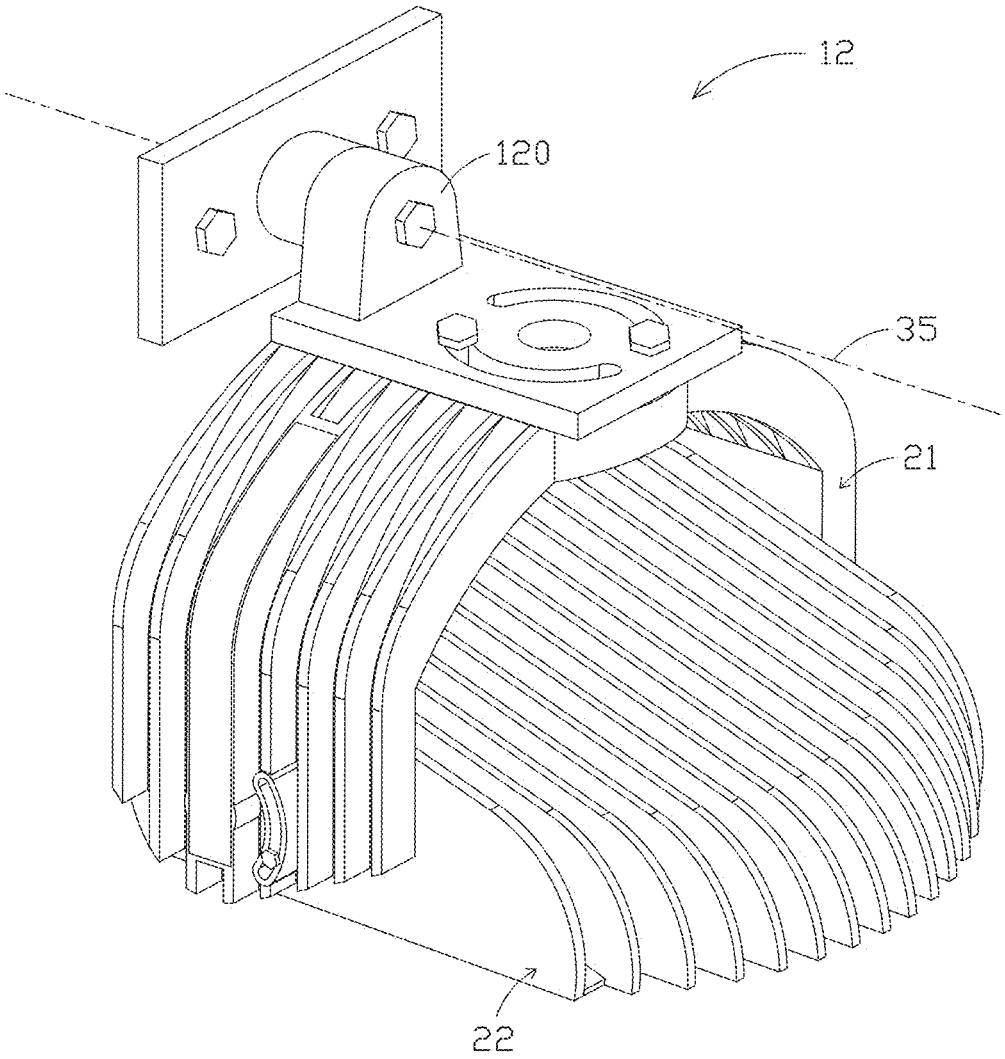
FIGS. 7A and B illustrate one possible way to provide a third pivot axis via modification of the structural components of modular apparatus of FIGS. 2A-F.
Figure 7B:
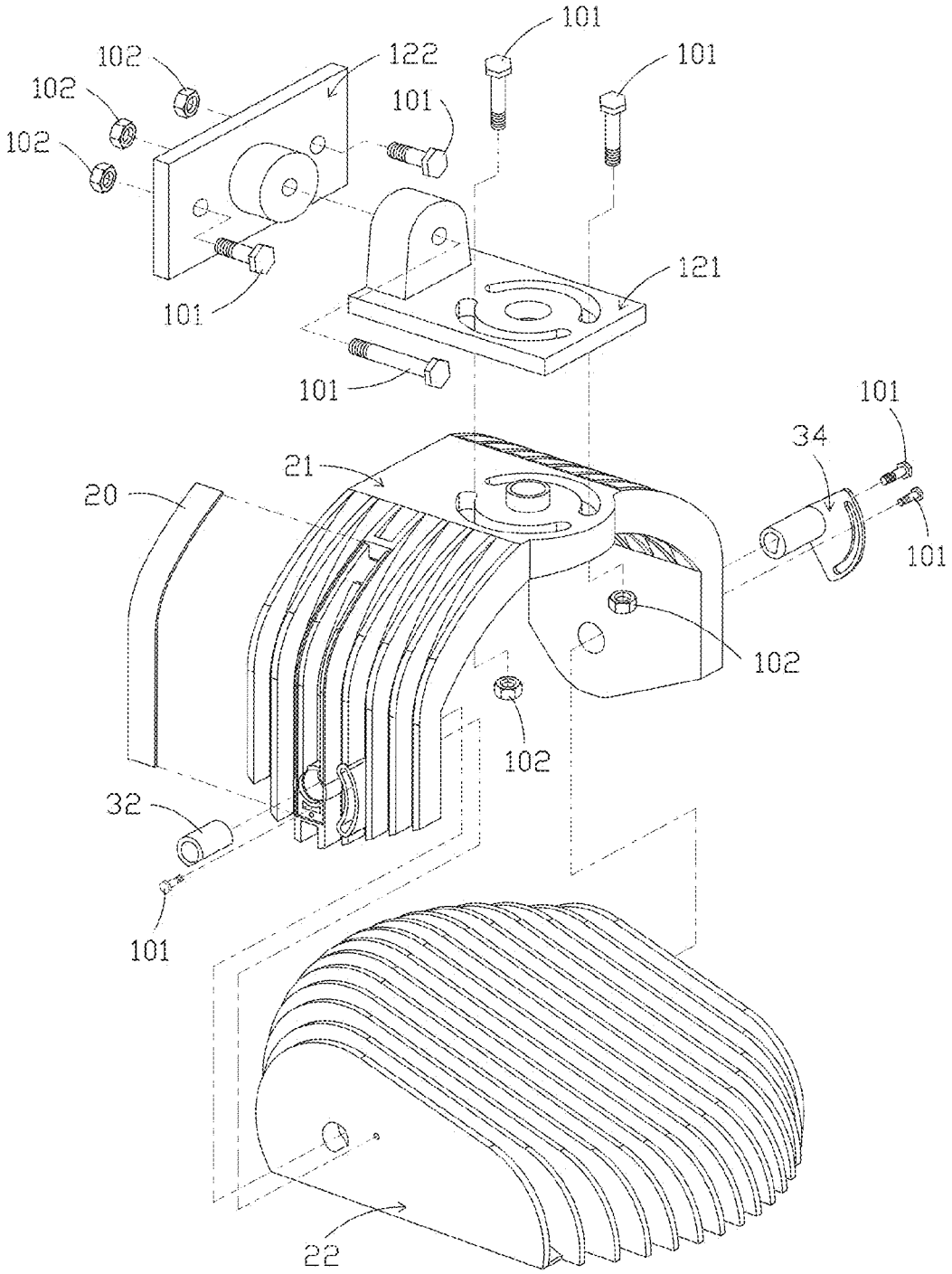

With regards to a lighting system comprising one or more fixtures 10, power regulating components (e.g., drivers, controllers, etc.) may be located remotely from fixture 10, may be housed in an electrical enclosure 1 affixed to an elevating device such as is illustrated in FIGS. 5A and B and is discussed in U.S. Pat. No, 7,059,572 incorporated by reference herein, or may be located somewhere on fixture 10. Further, control of power to the light sources 27 contained in fixture 10 may be effectuated on site or remotely such as is described in U.S. Pat. No. 7,209,958 incorporated by reference herein. A variety of approaches could be taken to provide power to a lighting system incorporating modular apparatuses 12 which do not depart from inventive aspects described herein.

What is claimed is:

1. A method of illuminating a target area with a composite beam pattern comprising:

a. defining one or more mounting locations for one or more lighting fixtures relative the target area, each lighting fixture producing an initial beam output from one or more lighting modules mounted thereto;

b. allocating one or more portions of the composite beam pattern to each of said lighting modules; and c. modifying the initial beam output of one or more lighting fixtures so to illuminate its allocated portion of the composite beam, wherein the modification comprises:

i. adjusting the lighting fixture or at least one lighting module of a lighting fixture relative its mounting location; and ii. adjusting a portion of the lighting module relative to and independently of another portion of the lighting module;

d. such that each initial beam output and modified initial beam output of each lighting fixture collectively produce the composite beam pattern.

2. The method of claim 1 wherein the adjusting the lighting fixture or at least one lighting module of a lighting fixture elative its mounting location comprises pivoting about a first pivot axis, and wherein the adjusting a portion of the lighting module relative to and independently of another portion of the lighting module comprises pivoting about a second axis, and wherein the first and second pivot axes are orthogonal.

3. The method of claim 1 wherein the adjusting the at least one module of a lighting fixture relative its mounting location comprises (i) pivoting the lighting module about its mounting location in a first plane and (ii) pivoting the lighting module relative its mounting location in a second plane.

4. The method of claim 1 wherein each lighting module comprises light directing means and light redirecting means, and wherein the adjusting a portion of the lighting module relative to and independently of another portion of the lighting module comprises pivoting the light redirecting means relative the light directing means.

5. The method of claim 1 wherein the independent adjusting a portion of the lighting module relative to another portion of the lighting module comprises pivoting and releasably fixing in position over a range of positions a. set of solid state light sources and independently pivoting and releasably fixing in position over a range of positions a visor for the said set of solid state light sources.

6. The method of claim 5 wherein the set of solid state light sources comprises a linear array.

7. The method of claim 6 wherein the visor comprises a reflective surface substantially parallel to the linear array of light sources.

8. The method of claim 7 wherein the linear array of light sources and the visor pivot around substantially the same axis.

9. The method of claim 8 wherein the module comprises an exterior that is aerodynamic.

10. A method of illuminating a target area according to a pre-defined composite beam pattern comprising:

a, identifying one or more factors related to a lighting plan for the target area;

b. developing a plurality of individual beam patterns which, when assembled, approximates the pre-defined composite beam pattern;

c. developing a lighting system comprising a plurality of lighting modular assemblies each of which produces an output which contributes to at least one individual beam pattern and comprises:

i. one or more light directing components including plural light sources pivotable about at least one axis;

ii. one or more light redirecting components pivotable about at least one axis and independently pivotable relative at least one axis of said light directing components; and d. installing the lighting system at the target area so to produce the composite beam pattern.

11. The method of claim 10 wherein the one or more factors related to a lighting plan for the target area comprises all of:

a. size of the target area;

b. shape of the target area;

c. number and layout of one or more elevating structures to which said one or more lighting modular assemblies are affixed;

d. wind loading conditions;

e. light level;

f. lighting uniformity; and g. color of light.

12. The method of claim 10 wherein said light directing means comprises one or more of:

a. a lens; and b. a filter.

13. The method of claim 10 Wherein said light redirecting means comprises one or more of:

a. a reflective device;

b. a diffuser; and c. light absorbing device.

14. A lighting module comprising:

a. an enclosure comprising a body having a length and an interior and an opening into said interior wherein the body is pivotable about a first pivot axis extending along the length of the body, the enclosure adapted to receive and positionally affix one or more light sources in its interior such that the one or more light sources project light generally along a first principal axis;

b. a structural component pivotably affixed to the enclosure and adapted to receive a reflective surface;

c. wherein the structural component is independently pivotable from the body along the first pivot axis.

15. The lighting module of claim 14 further comprising a light transmissive material adapted to seal against the opening of the body of the enclosure.

16. The lighting module of claim 14 wherein the structural component is further adapted to receive a light diffusive member.

17. The lighting module of claim 14 wherein the structural component is adapted to receive plural reflective surfaces.

18. The lighting module of claim 17 wherein plural reflective surfaces includes one or more rails having at least one reflective surface and extending more along the first principal axis of the light sources than transverse to it.

19. The lighting fixture module of claim 14 comprising an exterior that is aerodynamic.

* * * * *